US011965135B1

(12) United States Patent
Koseoglu

(10) Patent No.: US 11,965,135 B1
(45) Date of Patent: Apr. 23, 2024

(54) METHODS FOR REACTIVITY BASED HYDROPROCESSING

(71) Applicant: Saudi Arabian Oil Company, Dhahran (SA)

(72) Inventor: Omer Refa Koseoglu, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 18/299,171

(22) Filed: Apr. 12, 2023

(51) Int. Cl.
*C10G 45/22* (2006.01)

(52) U.S. Cl.
CPC ..... *C10G 45/22* (2013.01); *C10G 2300/1037* (2013.01); *C10G 2300/202* (2013.01);
(Continued)

(58) Field of Classification Search
CPC ..... C10G 45/22; C10G 2300/1037; C10G 2300/202; C10G 2300/301; C10G 2300/4006
See application file for complete search history.

(56) References Cited

U.S. PATENT DOCUMENTS 5,110,444 A 5/1992 Haun et al.
6,497,810 B1 12/2002 Laccino et al.
(Continued)

FOREIGN PATENT DOCUMENTS

WO 02074882 A1 9/2002

OTHER PUBLICATIONS

Haider et al., "Two-stage catalytic hydrotreatment of highly nitrogenous biocrude from continuous hydrothermal liquefaction: A rational design of the stabilization stage", Biomass and Bioenergy, vol. 139, 2020, 37 pages.
(Continued)

*Primary Examiner* — Ellen M McAvoy
*Assistant Examiner* — Chantel Graham
(74) *Attorney, Agent, or Firm* — DINSMORE & SHOHL LLP

(57) ABSTRACT

A method of hydroprocessing a hydrocarbon feed may comprise fractionating a hydrocarbon feed into "n" fractions, wherein "n" is at least 2; hydroprocessing an $(n-1)^{th}$ fraction of the hydrocarbon feed in an $(n-1)^{th}$ hydroprocessing reaction zone of a hydroprocessing unit, thereby producing an $(n-1)^{th}$ effluent The method may further comprise hydroprocessing the $n^{th}$ fraction and the $(n-1)^{th}$ effluent in an $n^{th}$ hydroprocessing reaction zone, thereby producing an $n^{th}$ effluent. The $(n-1)^{th}$ hydroprocessing reaction zone may be upstream of the $n^{th}$ hydroprocessing reaction zone. The $(n-1)^{th}$ fraction may have a greater boiling point range than the $n^{th}$ fraction. Hydrogen and the hydrocarbon feed may be in co-current flow in the hydroprocessing unit.

19 Claims, 2 Drawing Sheets

(52) U.S. Cl.
CPC ..... *C10G 2300/301* (2013.01); *C10G 2300/4006* (2013.01)

(56) References Cited

U.S. PATENT DOCUMENTS

| | | | | |
|---|---|---|---|---|
| 8,940,155 | B2 | 1/2015 | Koseoglu | |
| 8,951,406 | B2 | 2/2015 | Koseoglu | |
| 8,956,528 | B2 | 2/2015 | Koseoglu | |
| 9,144,752 | B2 | 9/2015 | Koseoglu | |
| 9,428,700 | B2 | 8/2016 | Koseoglu | |
| 9,719,029 | B2 | 8/2017 | Koseoglu | |
| 10,899,685 | B1 | 1/2021 | Koseoglu et al. | |
| 11,084,994 | B2 | 8/2021 | Koseoglu | |
| 11,155,757 | B2 | 10/2021 | Koseoglu | |
| 11,208,600 | B2 | 12/2021 | Huang et al. | |
| 11,267,769 | B2 * | 3/2022 | Koseoglu | B01J 14/005 |
| 2008/0223754 | A1 * | 9/2008 | Subramanian | C10G 69/04 196/14.52 |
| 2014/0291201 | A1 | 10/2014 | Banerjee et al. | |

OTHER PUBLICATIONS

Song, "An overview of new approaches to deep desulfurization for ultra-clean gasoline, diesel fuel and jet fuel", Catalysis Today, vol. 86, pp. 211-263, 2003.

* cited by examiner

METHODS FOR REACTIVITY BASED HYDROPROCESSING

BACKGROUND

Field

The present disclosure relates to processes for processing petroleum-based materials and, in particular, processes for hydrotreating hydrocarbon feeds to reduce contaminants.

Technical Background

The discharge into the atmosphere of sulfur compounds during processing and end-use of the petroleum products derived from sulfur-containing crude oil, such as sour crude oil, poses health and environmental problems. Stringent reduced-sulfur specifications applicable to transportation and other fuel products have impacted the refining industry. It is therefore necessary for refiners to make capital investments to dramatically reduce the sulfur content in gas oils. In industrialized nations such as the United States, Japan, and the countries of the European Union, refineries have already been required to produce environmentally clean transportation fuels. For instance, in 2007 the United States Environmental Protection Agency required the sulfur content of highway diesel fuel to be reduced 97%, from 500 ppmw (low sulfur diesel) to 15 ppmw (ultra-low sulfur diesel). The European Union has enacted even more stringent standards, requiring diesel and gasoline fuels sold in 2009 to contain less than 10 ppmw of sulfur. Other countries are following in the footsteps of the U.S. and the European Union and are moving forward with regulations that will require refineries to produce transportation fuels with ultra-low sulfur levels.

To meet these ultra-low sulfur requirements, refiners must choose among the various processes and crude oils which provide sufficient flexibility to meet future specifications with minimum additional capital investment. Ideally these future specifications can be met using existing equipment. Conventional technologies such as hydrocracking and two-stage hydrotreating offer solutions to refiners for the production of clean transportation fuels. These technologies are available and can be applied as new production facilities are constructed. However, many existing hydroprocessing facilities, such as those using relatively low-pressure hydrotreaters, represent a substantial prior investment and were constructed before these more stringent sulfur reduction requirements were enacted. It is difficult to upgrade existing hydrotreating reactors in these facilities to meet the new and more severe operational requirements (i.e., higher temperature and pressure). Available retrofitting options for refiners include elevation of the hydrogen partial pressure by increasing the recycle gas quality, utilization of more active catalyst compositions, installation of improved reactor components to enhance liquid-solid contact, increasing reactor volume, and increasing feedstock quality.

There are many hydrotreating units installed worldwide producing transportation fuels containing 500 ppmw-3000 ppmw sulfur. These units were designed for, and are being operated at, relatively mild conditions (i.e., low hydrogen partial pressures of 30 bar for straight run gas oils boiling in the range of 180° C. to 370° C.).

With the increasing prevalence of more stringent environmental sulfur specifications in transportation fuels mentioned above, the sulfur levels must often be reduced to less than 10 ppmw or 15 ppmw. This ultra-low level of sulfur typically requires either construction of new high-pressure hydrotreating units or a substantial retrofitting of existing facilities. For example it may require incorporating gas purification systems, reengineering the internal configuration and components of reactors, and/or deployment of more active catalyst compositions.

Sulfur-containing compounds that are typically present in hydrocarbon fuels include aliphatic molecules such as sulfides, disulfides and mercaptans as well as aromatic molecules such as thiophene, benzothiophene and its long chain alkylated derivatives, and dibenzothiophene and its alkyl derivatives such as 4,6-dimethyl-dibenzothiophene.

Aliphatic sulfur-containing compounds are more easily desulfurized (labile) using mild hydrodesulphurization methods. However, certain highly branched aromatic molecules can sterically hinder the sulfur atom removal and are more difficult to desulfurize (refractory) using mild hydrodesulphurization methods.

Among the sulfur-containing aromatic compounds, thiophenes and benzothiophenes are relatively easy to hydrodesulfurize. The addition of alkyl groups to the ring compounds increases the difficulty of hydrodesulphurization. Dibenzothiophenes resulting from addition of another ring to the benzothiophene family are even more difficult to desulfurize, and the difficulty varies greatly according to their alkyl substitution, with di-beta substitution being the most difficult to desulfurize, thus justifying their "refractory" appellation. These beta substituents hinder exposure of the heteroatom to the active site on the catalyst.

When previous regulations permitted sulfur levels up to 500 ppmw, there was little need or incentive to desulfurize beyond the capabilities of conventional hydrodesulphurization, and hence the refractory sulfur-containing compounds were not targeted. However, in order to meet the more stringent sulfur specifications, these refractory sulfur-containing compounds must be substantially removed from hydrocarbon fuels streams. Removal of sufficient sulfur-containing compounds from hydrocarbon fuels to achieve an ultra-low sulfur level is therefore very costly.

BRIEF SUMMARY

Accordingly, there is an ongoing need for processes, which can be retrofitted to existing refineries which will allow them to meet the ultra-low sulfur levels required. The processes of the present disclosure meet this need by providing hydroprocessing processes which fractionate a hydrocarbon feed and process the fractions based on their lability to hydrodesulphurization. Embodiments of the present disclosure may also meet this need through the use of co-current hydrogen feed and hydrogen in solution feeds. Embodiments of the present disclosure may optimize utilization of reactor space, catalyst volume, and reduce or eliminate the need for quench space.

According to at least one aspect of the present disclosure, a method of hydroprocessing a hydrocarbon feed may comprise fractionating the hydrocarbon feed into "n" fractions, wherein "n" is at least 2; hydroprocessing an $(n-1)^{th}$ fraction of the hydrocarbon feed in an $(n-1)^{th}$ hydroprocessing reaction zone of a hydroprocessing unit, thereby producing an $(n-1)^{th}$ effluent. The method may further comprise hydroprocessing the $n^{th}$ fraction and the $(n-1)^{th}$ effluent in an $n^{th}$ hydroprocessing reaction zone, thereby producing an $n^{th}$ effluent. The $(n-1)^{th}$ hydroprocessing reaction zone may be upstream of the $n^{th}$ hydroprocessing reaction zone. The $(n-1)^{th}$ fraction may have a greater boiling point range than the $n^{th}$ fraction. Hydrogen and the hydrocarbon feed may be in co-current flow in the hydroprocessing unit.

According to at least one aspect of the present disclosure, a method of hydroprocessing a hydrocarbon feed may comprise fractionating the hydrocarbon feed into "n" fractions, wherein "n" is at least 3; hydroprocessing an $(n-2)^{th}$ fraction of the hydrocarbon feed in an $(n-2)^{th}$ hydroprocessing reaction zone of a hydroprocessing unit, thereby producing an $(n-2)^{th}$ effluent; hydroprocessing an $(n-1)^{th}$ fraction of the hydrocarbon feed and the $(n-2)^{th}$ effluent in an $(n-1)^{th}$ hydroprocessing reaction zone of a hydroprocessing unit, thereby producing an $(n-1)^{th}$ effluent; and hydroprocessing the $n^{th}$ fraction and the $(n-1)^{th}$ effluent in an $n^{th}$ hydroprocessing reaction zone, thereby producing an $n^{th}$ effluent. The $(n-2)^{th}$ hydroprocessing reaction zone may be upstream of the $(n-1)^{th}$ hydroprocessing reaction zone and the $(n-1)^{th}$ hydroprocessing reaction zone may be upstream of the $n^{th}$ hydroprocessing reaction zone. The $(n-2)^{th}$ fraction may have a greater boiling point range than the $(n-1)^{th}$ fraction and the $(n-1)^{th}$ fraction may have a greater boiling point range than the $n^{th}$ fraction. Hydrogen and the hydrocarbon feed may be in co-current flow in the hydroprocessing unit.

Additional features and advantages of the aspects of the present disclosure will be set forth in the detailed description that follows and, in part, will be readily apparent to a person of ordinary skill in the art from the detailed description or recognized by practicing the aspects of the present disclosure.

BRIEF DESCRIPTION OF THE SEVERAL VIEWS OF THE DRAWINGS

To easily identify the discussion of any particular element or act, the most significant digit or digits in a reference number refer to the figure number in which that element is first introduced.

Figure 1:
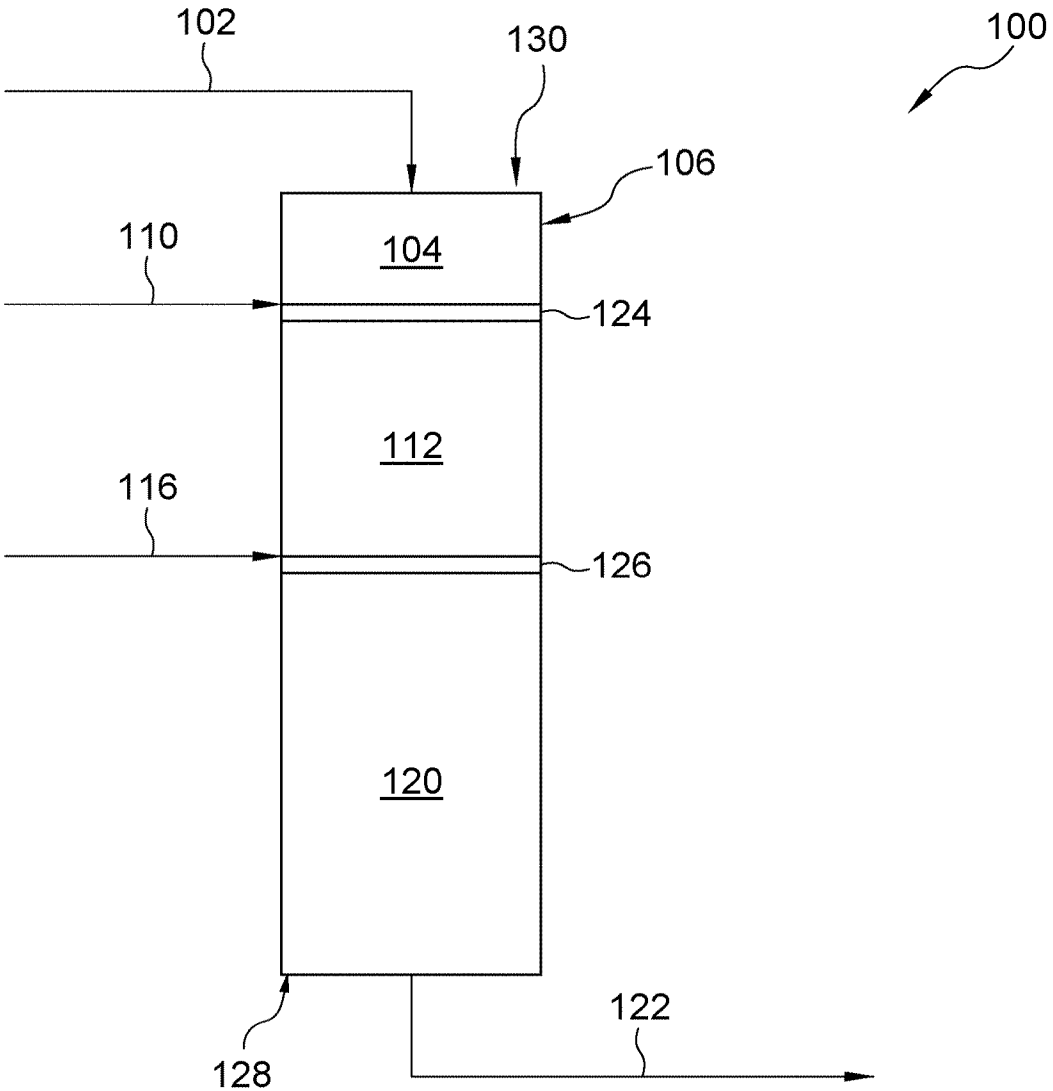
FIG. 1 schematically depicts a generalized flow diagram of a single, multi-zone hydroprocessing reactor for steam hydroprocessing a hydrocarbon feed, according to one or more embodiments shown and described in the present disclosure.

When describing the simplified schematic illustrations of the figures, the numerous valves, temperature sensors, electronic controllers, and the like, which may be used and are well known to a person of ordinary skill in the art, may not be included. Further, accompanying components that are often included in systems such as those depicted in the figures, such as air supplies, heat exchangers, surge tanks, and the like also may not be included. However, a person of ordinary skill in the art understands that these components are within the scope of the present disclosure.

Additionally, the arrows in the simplified schematic illustrations of the figures refer to process streams. However, the arrows may equivalently refer to transfer lines, which may transfer process steams between two or more system components. Arrows that connect to one or more system components signify inlets or outlets in the given system components and arrows that connect to only one system component signify a system outlet stream that exits the depicted system or a system inlet stream that enters the depicted system. The arrow direction generally corresponds with the major direction of movement of the process stream or the process stream contained within the physical transfer line signified by the arrow.

The arrows in the simplified schematic illustrations of the figures may also refer to process steps of transporting a process stream from one system component to another system component. For example, an arrow from a first system component pointing to a second system component may signify "passing" a process stream from the first system component to the second system component, which may comprise the process stream "exiting" or being "removed" from the first system component and "introducing" the process stream to the second system component.

Reference will now be made in greater detail to various aspects, some of which are illustrated in the accompanying drawings.

DETAILED DESCRIPTION

The present disclosure is directed to methods of hydroprocessing a hydrocarbon feed to meet the ultra-low sulfur levels required by modern fuel standards. The methods of the present disclosure meet this need by fractionating a hydrocarbon feed into "n" fractions and hydroprocessing each fraction in a separate hydroprocessing reaction zone based on the reactivity of the feed to hydroprocessing processes. The methods of the present disclosure further meet this need by providing hydrogen and hydrocarbon feed co-current reaction systems and 2 phase (hydrocarbon and catalyst) reaction systems, whereby at least some of the hydrogen used for hydroprocessing is dissolved in the hydrocarbon feed fractions.

Definitions

As used in the present disclosure, the term "API" refers to the American Petroleum Institute.

As used in the present disclosure, the term "cracking" refers to a chemical reaction where a molecule having carbon-carbon bonds is broken into more than one molecule by the breaking of one or more of the carbon-carbon bonds; where a compound including a cyclic moiety, such as an aromatic, is converted to a compound that does not include a cyclic moiety; or where a molecule having carbon-carbon double bonds are reduced to carbon-carbon single bonds or carbon-hydrogen bonds. As used in the present disclosure, the term "catalytic cracking" refers to cracking conducted in the presence of a catalyst. Some catalysts may have multiple forms of catalytic activity, and calling a catalyst by one particular function does not render that catalyst incapable of being catalytically active for other functionality.

As used in the present disclosure, the term "catalyst" refers to any substance that increases the rate of a specific chemical reaction, such as cracking reactions.

As used in the present disclosure, the term "crude oil" refers to a mixture of petroleum liquids and gases, including impurities, such as sulfur-containing compounds, nitrogen-containing compounds, and metal compounds, extracted directly from a subterranean formation or received from a desalting unit without having any fractions, such as naphtha, separated by distillation.

As used in the present disclosure, the term "directly" refers to the passing of materials, such as an effluent, from a first component of the system to a second component of the system without passing the materials through any intervening components or systems operable to change the composition of the materials. Similarly, the term "directly" also refers to the introducing of materials, such as a feed, to a component of the system without passing the materials through any preliminary components operable to change the composition of the materials. Intervening or preliminary components or systems operable to change the composition of the materials can include hydrotreaters and separators, but are not generally intended to include heat exchangers, valves, pumps, sensors, or other ancillary components required for operation of a chemical process. Further, combining two streams together upstream of the second component instead of passing each stream to the second component separately is also not considered to be an intervening or preliminary component operable to change the composition of the materials.

As used in the present disclosure, the terms "downstream" and "upstream" refer to the positioning of components or systems relative to a direction of flow of materials through the system. For example, a second component may be considered "downstream" of a first component if materials flowing through the system encounter the first component before encountering the second component. Likewise, the first component may be considered "upstream" of the second component if the materials flowing through the system encounter the first component before encountering the second component.

As used in the present disclosure, the term "effluent" refers to a stream that is passed out of a hydrotreater, a reaction zone, or a separator following a particular reaction or separation. Generally, an effluent has a different composition than the stream that entered the hydrotreater, reaction zone, or separator. It should be understood that when an effluent is passed to another component or system, only a portion of that effluent may be passed. For example, a slipstream may carry some of the effluent away, meaning that only a portion of the effluent may enter the downstream component or system. The terms "reaction effluent" and "hydrotreater effluent" particularly refer to a stream that is passed out of a hydrotreater or reaction zone.

As used in the present disclosure, the term "LHSV" means liquid hourly space velocity. The LHSV is calculated as the volumetric flowrate of feedstock divided by the volume of catalyst. The units of LHSV are 1 over hours ($h^{-1}$).

As used in the present disclosure, the term "WABT" means weighted average bed temperature. WABT may be calculated according to the equation $$WABT = \sum_{i=1}^{N} WABT_i * W_{C_i},$$

where $WABT_i$ is the WABT for a particular section of catalyst bed, "N" is the number of catalyst beds, and $Wc_i$ is the $i^{th}$ bed's weight fraction of the total bed weight.

As used in the present disclosure, the term "hydrotreater" refers to any vessel, container, conduit, or the like, in which a chemical reaction, such as catalytic cracking, occurs between one or more reactants optionally in the presence of one or more catalysts. A hydrotreater can include one or a plurality of "reaction zones" disposed within the hydrotreater. The term "reaction zone" refers to a region in a hydrotreater where a particular reaction takes place.

As used in the present disclosure, the term "precious metals" refers to platinum, palladium, ruthenium, rhodium, osmium, and iridium.

As used in the present disclosure, the terms "separation unit" and "separator" refer to any separation device(s) that at least partially separates one or more chemical constituents in a mixture from one another. For example, a separation system selectively separates different chemical constituents from one another, forming one or more chemical fractions. Examples of separation systems include, without limitation, distillation columns, fractionators, flash drums, knockout drums, knockout pots, centrifuges, filtration devices, traps, scrubbers, expansion devices, membranes, solvent extraction devices, high-pressure separators, low-pressure separators, or combinations of these. The separation processes described in the present disclosure may not completely separate all of one chemical constituent from all of another chemical constituent. Instead, the separation processes described in the present disclosure "at least partially" separate different chemical constituents from one another and, even if not explicitly stated, separation can include only partial separation.

Embodiments

A method of hydroprocessing a hydrocarbon feed may comprise hydroprocessing the hydrocarbon feed in a hydroprocessing unit. The hydroprocessing unit may comprise multiple hydroprocessing reaction zones, disposed either in a single hydroprocessing reactor or in separate hydroprocessing reactors. The method may comprise fractionating the hydrocarbon feed into "n" fractions, wherein "n" is at least 2; hydroprocessing an $(n-1)^{th}$ fraction of the hydrocarbon feed in an $(n-1)^{th}$ hydroprocessing reaction zone of a hydroprocessing unit, thereby producing an $(n-1)^{th}$ effluent. The method may further comprise hydroprocessing an $n^{th}$ fraction of the hydrocarbon feed and the $(n-1)^{th}$ effluent in an $n^{th}$ hydroprocessing reaction zone, thereby producing an $n^{th}$ effluent. The $(n-1)^{th}$ hydroprocessing reaction zone may be upstream of the $n^{th}$ hydroprocessing reaction zone. The $(n-1)^{th}$ fraction may have a greater boiling point range than the $n^{th}$ fraction.

Referring now to FIG. 1, a method 100 of hydroprocessing a hydrocarbon feed may comprise hydroprocessing the hydrocarbon feed in a hydroprocessing unit 106 comprising a single hydroprocessing reactor. The hydroprocessing reactor may comprise multiple hydroprocessing reaction zones 104, 112, 120. Specifically, the method 100 may comprise fractionating the hydrocarbon feed into "n" fractions, wherein n is at least 3; hydroprocessing an $(n-2)^{th}$ fraction 102 of the hydrocarbon feed in an $(n-2)^{th}$ hydroprocessing reaction zone 104 of the hydroprocessing unit 106, thereby producing an $(n-2)^{th}$ effluent; hydroprocessing an $(n-1)^{th}$ fraction 110 of the hydrocarbon feed and the $(n-2)^{th}$ effluent in an $(n-1)^{th}$ hydroprocessing reaction zone 112 of a hydroprocessing unit 106, thereby producing an $(n-1)^{th}$ effluent; and hydroprocessing an $n^{th}$ fraction 116 of the hydrocarbon feed and the $(n-1)^{th}$ effluent in an $n^{th}$ hydroprocessing reaction zone 120, thereby producing an $n^{th}$ effluent 122. The $(n-2)^{th}$ hydroprocessing reaction zone 104 may be upstream of the $(n-1)^{th}$ hydroprocessing reaction zone 112 and the $(n-1)^{th}$ hydroprocessing reaction zone 112 may be upstream of the $n^{th}$ hydroprocessing reaction zone 120. The $(n-2)^{th}$ fraction 102 may have a greater boiling point range than the $(n-1)^{th}$ fraction 110, and the $(n-1)^{th}$ fraction 110 may have a greater boiling point range than the $n^{th}$ fraction 116. It should be understood that the $(n-2)^{th}$ effluent and the $(n-1)^{th}$ effluent are not depicted in FIG. 1 as they do not leave the hydroprocessing reactor in those embodiments. Rather, in the embodiments of FIG. 1, the $(n-2)^{th}$ effluent and the $(n-1)^{th}$ effluent are directed through the hydroprocessing reactor from the bottom of one hydroprocessing reaction zone to the top of the next hydroprocessing reaction zone.

Without being limited by theory, it is believed that the greater boiling point range fractions may contain higher concentrations of sulfur and difficult to desulfurize compounds, relative to lesser boiling point range fractions. Therefore, causing the greater boiling point range fractions to experience multiple hydroprocessing steps while the lesser boiling point range fractions experience fewer hydroprocessing steps may result in improved desulfurization while optimizing reactor volume. For example, the greatest boiling point range fractions, such as the $(n-2)^{th}$ fraction, may experience at least three hydroprocessing steps while the lowest boiling point range fraction, the $n^{th}$ fraction may only experience one hydroprocessing step.

Figure 2:
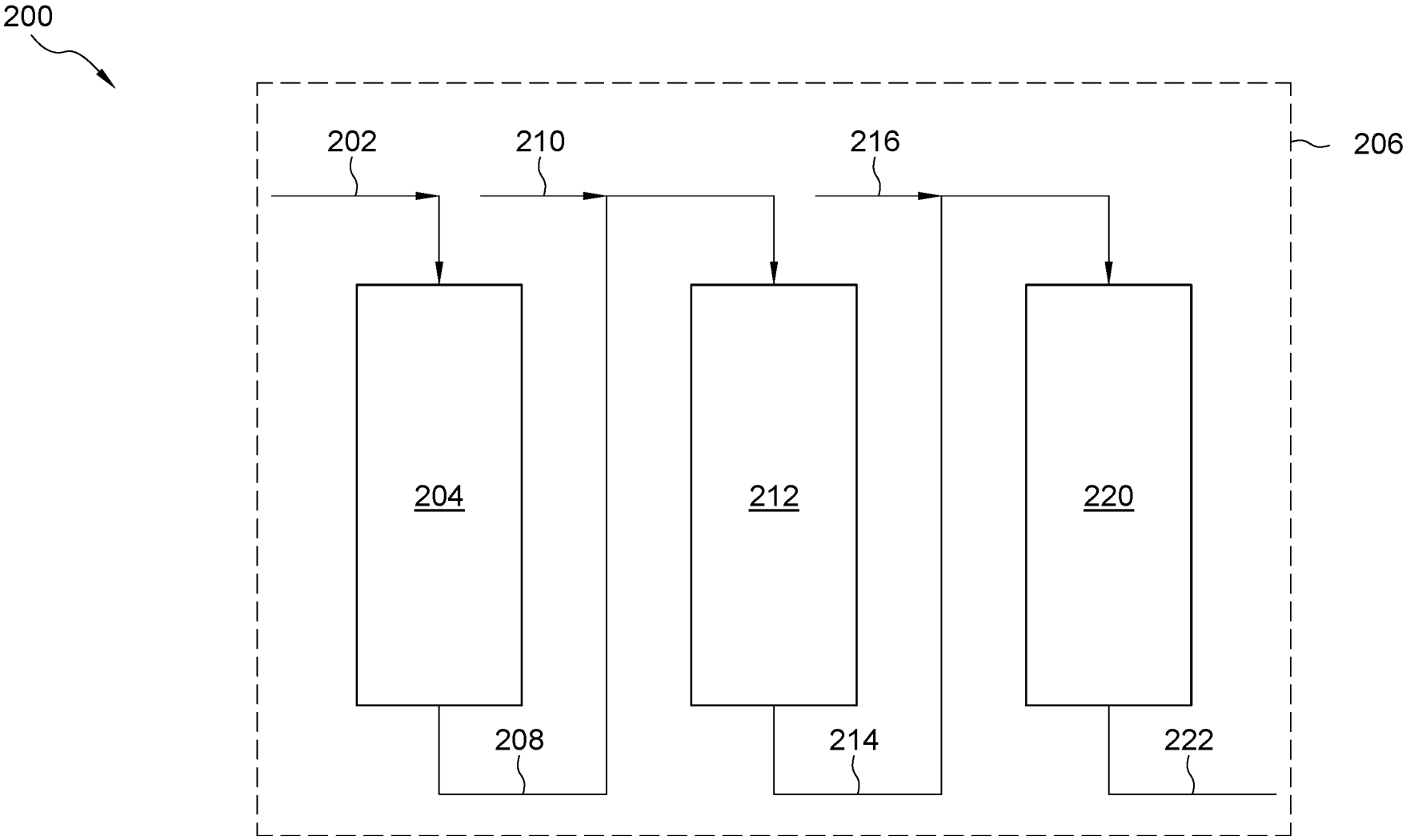
FIG. 2 schematically depicts a generalized flow diagram of a hydroprocessing unit comprising a system of multiple hydroprocessing reactors in series, for hydroprocessing a hydrocarbon feed, according to one or more embodiments shown and described in the present disclosure.

Referring now to FIG. 2, a method 200 of hydroprocessing a hydrocarbon feed may comprise hydroprocessing the hydrocarbon feed in a hydroprocessing unit 206 comprising multiple hydroprocessing reactors, each hydroprocessing reactor comprising a single reaction zone 204, 212, 220. Specifically, the method 200 may comprise fractionating the hydrocarbon feed into "n" fractions; hydroprocessing an $(n-2)^{th}$ fraction 202 of the hydrocarbon feed in an $(n-2)^{th}$ hydroprocessing reaction zone 204 of a hydroprocessing unit 206, thereby producing an $(n-2)^{th}$ effluent 208; hydroprocessing an $(n-1)^{th}$ fraction 210 of the hydrocarbon feed and the $(n-2)^{th}$ effluent 208 in an $(n-1)^{th}$ hydroprocessing reaction zone 212 of the hydroprocessing unit 206, thereby producing an $(n-1)^{th}$ effluent 214; and hydroprocessing the $n^{th}$ fraction 216 and the $(n-1)^{th}$ effluent 214 in an $n^{th}$ hydroprocessing reaction zone 220, thereby producing an $n^{th}$ effluent 222. The $(n-2)^{th}$ hydroprocessing reaction zone 204 may be upstream of the $(n-1)^{th}$ hydroprocessing reaction zone 212 and the $(n-1)^{th}$ hydroprocessing reaction zone 212 may be upstream of the $n^{th}$ hydroprocessing reaction zone 220.

It should be understood that hybrids of the embodiments depicted in FIG. 1 and FIG. 2 are envisioned, wherein some, but not all, of the hydroprocessing reaction zones are contained within a single hydroprocessing reactor. Further embodiments are envisioned wherein each of the reactors depicted in the embodiments of FIG. 2 include multiple reaction zones. It is believed that the single reactor, multiple reaction zone embodiments, as depicted in FIG. 1 may be simpler than multiple reactor embodiments as depicted in FIG. 2. However, the multiple reactor embodiments depicted in FIG. 2 may be easier to operate (temperature control) and feed. No separate mixing zone may be required in such embodiments as mixing may occur in the transport pipes. The individual reactors may be smaller, and thereby cheaper, easier to construct, easier to transport, and easier to install. As stated above, the number of reaction zones, whether contained in a single reactor as depicted in FIG. 1 or in multiple reactors as depicted in FIG. 2, is denoted by "n." "n" may be an integer greater than or equal to 2, such as an integer from 2 to 10, from 3 to 10, from 3 to 9, from 3 to 8, from 3 to 7, from 3 to 6, from 3 to 5, from 3 to 4, from 4 to 10, from 4 to 8, from 4 to 6, or any subset thereof. In embodiments, "n" may be 2, 3, 4, 5, 6, 7, 8, 9, or 10.

In embodiments where "n" is greater than 3, the $(n-3)^{th}$ fraction may hydroprocessed in the $(n-3)^{th}$ hydroprocessing reaction zone, thereby producing an $(n-3)^{th}$ effluent, the $(n-3)^{th}$ effluent may be hydroprocessed in the $(n-2)^{th}$ hydroprocessing reaction zone in conjunction with the $(n-2)^{th}$ fraction, thereby producing the $(n-2)^{th}$ effluent. The $(n-3)^{th}$ hydroprocessing reaction zone may be upstream of the $(n-2)^{th}$ hydroprocessing reaction zone and the $(n-3)^{th}$ fraction may have a greater boiling point range than the $(n-2)^{th}$ fraction. The $(n-4)^{th}$ fraction may be hydroprocessed in the $(n-4)^{th}$ hydroprocessing reaction zone, thereby producing an $(n-4)^{th}$ effluent, the $(n-4)^{th}$ effluent may be hydroprocessed in the $(n-3)^{th}$ hydroprocessing reaction zone, in conjunction with the $(n-3)^{th}$ fraction, thereby producing the $(n-3)^{th}$ effluent. The $(n-4)^{th}$ hydroprocessing reaction zone may be upstream of the $(n-3)^{th}$ hydroprocessing reaction zone and the $(n-4)^{th}$ fraction may have a greater boiling point range than the $(n-3)^{th}$ fraction. This pattern may repeat until all "n" fractions have been introduced to their respective hydroprocessing reaction zones.

As depicted in FIG. 1 and FIG. 2, in embodiments where n=3, the method 100, 200 may comprise fractionating the hydrocarbon feed into "n" fractions; hydroprocessing a $1^{st}$ fraction 102, 202 in a $1^{st}$ hydroprocessing reaction zone 104, 204 of a hydroprocessing unit 106, 206, thereby producing a $1^{st}$ effluent 208; hydroprocessing a $2^{nd}$ fraction 110, 210 and the $1^{st}$ effluent 208 in a $2^{nd}$ hydroprocessing reaction zone 112, 212 of a hydroprocessing unit 106, 206, thereby producing a $2^{nd}$ effluent 214; and hydroprocessing the $3^{rd}$ fraction 116, 216 and the $2^{nd}$ effluent 214 in a $3^{rd}$ hydroprocessing reaction zone 120, 220, thereby producing a $3^{rd}$ effluent 122, 222. The $1^{st}$ hydroprocessing reaction zone 104, 204 may be upstream of the $2^{nd}$ hydroprocessing reaction zone 112, 212 and the $2^{nd}$ hydroprocessing reaction zone 112, 212 may be upstream of the $3^{rd}$ hydroprocessing reaction zone 120, 220. The $1^{st}$ fraction 102, 202 may have a greater boiling point range than the $2^{nd}$ fraction 110, 210, and the $2^{nd}$ fraction 110, 210 may have a greater boiling point range than the $3^{rd}$ fraction 116, 216.

The hydrocarbon feed may include one or more heavy oils, such as but not limited to crude oil, bitumen, oil sand, shale oil, coal liquids, vacuum residue, tar sands, other heavy oil streams, or combinations of these heavy oils. It should be understood that, as used in this disclosure, a "heavy oil" refers to a raw hydrocarbon, such as whole crude oil, which has not been previously processed through distillation, or may refer to a hydrocarbon oil, which has undergone some degree of processing prior to being introduced to the process as the hydrocarbon feed. The hydrocarbon feed may have a density of greater than or equal to 0.80 grams per milliliter. The hydrocarbon feed may have an end boiling point (EBP) of greater than 565° C. The hydrocarbon feed may have a concentration of nitrogen of less than or equal to 3000 parts per million by weight (ppmw).

In embodiments, the hydrocarbon feed, such as crude oil, may not have undergone hydroprocessing before being fractionated and fed to the hydroprocessing unit 106, 206. Without being limited by theory, a hydrocarbon feed which has not been hydroprocessed may contain additional contaminants, such as metals, relative to a hydrocarbon feed which has been hydroprocessed. Embodiments of the present disclosure may be able to tolerate the higher levels of contaminants present in a non-hydroprocessed feed.

In embodiments, the hydrocarbon feed may be a crude oil, such as whole crude oil, or synthetic crude oil. The crude oil may have an American Petroleum Institute (API) gravity of from 22 degrees to 52 degrees, such as from 25 degrees to 52 degrees, from 22 degrees to 40 degrees, from 25 degrees to 50 degrees, or from 25 degrees to 40 degrees. In embodiments, the hydrocarbon feed may include an extra light crude oil, a light crude oil, a heavy crude oil, or combinations of these. In embodiments, the hydrocarbon feed can be a light crude oil, such as but not limited to an Arab heavy crude oil, an Arab medium crude oil, an Arab light (AL) export crude oil, an Arab extra light crude oil, or an Arab super light crude oil. The hydrocarbon feed may have a sulfur content of from 0.05 wt. % to 3 wt. %. In embodiments, the hydrocarbon feed may have a sulfur content of from 0.05 wt. % to 2.75 wt. %, from 0.05 wt. % to 2.50 wt. %, from 0.05 wt. % to 2.25 wt. %, from 0.05 wt. % to 2.00 wt. %, from 0.1 wt. % to 3 wt. %, from 0.5 wt. % to 3 wt. %, from 1 wt. % to 3 wt. %, from 1.5 wt. % to 3 wt. %, from 1.5 wt. % to 2.5 wt. %, or any subset thereof.

When the hydrocarbon feed comprises a crude oil, the crude oil may be a whole crude or may be a crude oil that has undergone at least some processing, such as desalting, solids separation, solvent deasphalting, demetallization, or scrubbing. In embodiments, the hydrocarbon feed may be a de-salted crude oil that has been subjected to a de-salting process. In embodiments, the hydrocarbon feed may include a crude oil that has not undergone pretreatment, separation (such as distillation), or other operations or process that changes the hydrocarbon composition of the crude oil prior to introducing the crude oil to the process.

In embodiments, the hydrocarbon feed can be a crude oil having a boiling point profile as described by the 5 wt. % boiling temperature, the 25 wt. % boiling temperature, the 50 wt. % boiling temperature, the 75 wt. % boiling temperature, and the 95 wt. % boiling temperature. These respective boiling temperatures correspond to the temperatures at which a given weight percentage of the hydrocarbon feed stream boils. In embodiments, the crude oil may have one or more of a 5 wt. % boiling temperature of less than or equal to 150° C.; a 25 wt. % boiling temperature of less than or equal to 225° C. or less than or equal to 200° C.; a 50 wt. % boiling temperature of less than or equal to 500° C., less than or equal 450° C., or less than or equal to 400° C.; a 75 wt. % boiling temperature of less than 600° C., less than or equal to 550° C.; a 95 wt. % boiling temperature of greater than or equal to 550° C. or greater than or equal to 600° C.; or combinations of these. In embodiments, the crude oil may have one or more of a 5 wt. % boiling temperature of from 0° C. to 100° C.; a 25 wt. % boiling temperature of from 150° C. to 250° C., a 50 wt. % boiling temperature of from 250° C. to 400° C., a 75 wt. % boiling temperature of from 350° C. to 600° C. and an end boiling point temperature of from 500° C. to 1000° C., such as from 500° C. to 800° C.

In embodiments, at least 50 wt. %, such as at least 75 wt. %, at least 80 wt. %, at least 85 wt. %, at least 90 wt. %, at least 95 wt. %, or even at least 99 wt. % of hydrocarbons in the hydrocarbon feed may boil at a temperature of between 36° C. and 180° C., based on the total weight of hydrocarbons in the hydrocarbon feed. In embodiments, at least 50 wt. %, such as at least 75 wt. %, at least 80 wt. %, at least 85 wt. %, at least 90 wt. %, at least 95 wt. %, or even at least 99 wt. % of hydrocarbons in the hydrocarbon feed may boil at a temperature of between 180° C. and 370° C., based on the total weight of hydrocarbons in the hydrocarbon feed. In embodiments, at least 50 wt. %, such as at least 75 wt. %, at least 80 wt. %, at least 85 wt. %, at least 90 wt. %, at least 95 wt. %, or even at least 99 wt. % of hydrocarbons in the hydrocarbon feed may boil at a temperature of between 370° C. and 565° C., based on the total weight of hydrocarbons in the hydrocarbon feed. In embodiments, at least 50 wt. %, such as at least 75 wt. %, at least 80 wt. %, at least 85 wt. %, at least 90 wt. %, at least 95 wt. %, or even at least 99 wt. % of hydrocarbons in the hydrocarbon feed boil at a temperature of greater than 565° C., based on the total weight of hydrocarbons in the hydrocarbon feed.

In embodiments, the hydrocarbon feed may be a hydrocarbon residue fraction and the hydroprocessing unit 106, 206 may be a residue hydroprocessing unit. In embodiments, the hydrocarbon residue fraction may boil at a temperature of at least 575° C., such as from 575° C. to 2000° C., from 575° C. to 1500° C., from 575° C. to 1000° C., or any subset thereof.

Fractionating the hydrocarbon feed to produce the "n" fractions may occur in any separator. For example, the fractionating step may include, without limitation, distillation columns, fractionators, flash drums, knockout drums, knockout pots, centrifuges, filtration devices, traps, scrubbers, expansion devices, membranes, solvent extraction devices, high-pressure separators, low-pressure separators, or combinations of these.

Each hydrocarbon fraction may have a greater boiling point range than the fraction introduced to the hydroprocessing unit 106, 206 downstream of it. In embodiments, the $(n-2)^{th}$ fraction 102, 202 may have a greater boiling point range than the $(n-1)^{th}$ fraction 110, 210. In embodiments, the $(n-1)^{th}$ fraction 110, 210 may have a greater boiling point range than the $n^{th}$ fraction 116, 216. Each hydrocarbon fraction may boil at a greater boiling point than the fraction downstream of it. In embodiments, 10 wt. % of the hydrocarbons in each feed fraction may boil at a temperature of at least 5° C., at least 10° C., at least 20° C., at least 30° C., at least 35° C., at least 40° C., at least 50° C., from 5° C. to 100° C., from 20° C. to 100° C., from 30° C. to 100° C., from 40° C. to 100° C., from 50° C. to 100° C., from 20° C. to 80° C., from 20° C. to 70° C., from 30° C. to 80° C., from 30° C. to 70° C., from 35° C. to 70° C., or any subset thereof, greater than 10 wt. % of the hydrocarbons in the feed fraction downstream of it. In embodiments, 10 wt. % of the hydrocarbons in the $(n-2)^{th}$ fraction 102, 202 may have a boiling point of at least 5° C., at least 10° C., at least 20° C., at least 30° C., at least 35° C., at least 40° C., at least 50° C., from 5° C. to 100° C., from 20° C. to 100° C., from 30° C. to 100° C., from 40° C. to 100° C., from 50° C. to 100° C., from 20° C. to 80° C., from 20° C. to 70° C., from 30° C. to 80° C., from 30° C. to 70° C., from 35° C. to 70° C., or any subset thereof, greater than 10 wt. % of the hydrocarbons in the $(n-1)^{th}$ fraction 110, 210. In embodiments, 10 wt. % of the hydrocarbons in the $(n-1)^{th}$ fraction 110, 210 may have a boiling point of at least 5° C., at least 10° C., at least 20° C., at least 30° C., at least 35° C., at least 40° C., at least 50° C., from 5° C. to 100° C., from 20° C. to 100° C., from 30° C. to 100° C., from 40° C. to 100° C., from 50° C. to 100° C., from 20° C. to 80° C., from 20° C. to 70° C., from 30° C. to 80° C., from 30° C. to 70° C., from 35° C. to 70° C., or any subset thereof, greater than 10 wt. % of the hydrocarbons in the $n^{th}$ fraction 120, 220.

50 wt. % of the hydrocarbons in each feed fraction may boil at a temperature of at least 5° C., at least 10° C., at least 20° C., at least 30° C., at least 35° C., at least 40° C., at least 50° C., from 5° C. to 100° C., from 20° C. to 100° C., from 30° C. to 100° C., from 40° C. to 100° C., from 50° C. to 100° C., from 20° C. to 80° C., from 20° C. to 70° C., from 30° C. to 80° C., from 30° C. to 70° C., from 35° C. to 70° C., or any subset thereof, greater than 50 wt. % of the hydrocarbons in the feed fraction downstream of it. In embodiments, 50 wt. % of the hydrocarbons in the $(n-2)^{th}$ fraction 102, 202 may have a boiling point of at least 5° C., at least 10° C., at least 20° C., at least 30° C., at least 35° C., at least 40° C., at least 50° C., from 5° C. to 100° C., from 20° C. to 100° C., from 30° C. to 100° C., from 40° C. to 100° C., from 50° C. to 100° C., from 20° C. to 80° C., from 20° C. to 70° C., from 30° C. to 80° C., from 30° C. to 70° C., from 35° C. to 70° C., or any subset thereof, greater than 50 wt. % of the hydrocarbons in the $(n-1)^{th}$ fraction 110, 210. In embodiments, 50 wt. % of the hydrocarbons in the $(n-1)^{th}$ fraction 110, 210 may have a boiling point of at least 5° C., at least 10° C., at least 20° C., at least 30° C., at least 35° C., at least 40° C., at least 50° C., from 5° C. to 100° C., from 20° C. to 100° C., from 30° C. to 100° C., from 40° C. to 100° C., from 50° C. to 100° C., from 20° C. to 80° C., from 20° C. to 70° C., from 30° C. to 80° C., from 30° C. to 70° C., from 35° C. to 70° C., or any subset thereof, greater than 50 wt. % of the hydrocarbons in the $n^{th}$ fraction 116, 216.

90 wt. % of the hydrocarbons in each feed fraction may boil at a temperature of at least 5° C., at least 10° C., at least 20° C., at least 30° C., at least 35° C., at least 40° C., at least 50° C., from 5° C. to 100° C., from 20° C. to 100° C., from 30° C. to 100° C., from 40° C. to 100° C., from 50° C. to 100° C., from 20° C. to 80° C., from 20° C. to 70° C., from 50° C. to 80° C., from 40° C. to 70° C., from 50° C. to 70° C., or any subset thereof, greater than 90 wt. % of the hydrocarbons in the feed fraction downstream of it. In embodiments, 90 wt. % of the hydrocarbons in the $(n-2)^{th}$ fraction 102, 202 may have a boiling point of at least 5° C., at least 10° C., at least 20° C., at least 30° C., at least 35° C., at least 40° C., at least 50° C., from 5° C. to 100° C., from 20° C. to 100° C., from 30° C. to 100° C., from 40° C. to 100° C., from 50° C. to 100° C., from 20° C. to 80° C., from 20° C. to 70° C., from 30° C. to 80° C., from 30° C. to 70° C., from 35° C. to 70° C., or any subset thereof, greater than 90 wt. % of the hydrocarbons in the $(n-1)^{th}$ fraction 110, 210. In embodiments, 90 wt. % of the hydrocarbons in the $(n-1)^{th}$ fraction 110, 210 may have a boiling point of at least 5° C., at least 10° C., at least 20° C., at least 30° C., at least 35° C., at least 40° C., at least 50° C., from 5° C. to 100° C., from 20° C. to 100° C., from 30° C. to 100° C., from 40° C. to 100° C., from 50° C. to 100° C., from 20° C. to 80° C., from 20° C. to 70° C., from 30° C. to 80° C., from 30° C. to 70° C., from 35° C. to 70° C., or any subset thereof, greater than 90 wt. % of the hydrocarbons in the $n^{th}$ fraction 116, 216.

In some embodiments, at least 50 wt. %, such as at least 60 wt. %, at least 70 wt. %, at least 80 wt. %, at least 90 wt. %, at least 95 wt. %, at least 99 wt. %, from 50 wt. % to 100 wt. %, from 60 wt. % to 100 wt. %, from 70 wt. % to 100 wt. %, from 80 wt. % to 100 wt. %, from 90 wt. % to 100 wt. %, from 95 wt. % to 100 wt. %, or even from 99 wt. % to 100 wt. % of hydrocarbons in the $(n-2)^{th}$ fraction may boil at a temperature of between 180° C. and 260° C., based on the total weight of hydrocarbons in the $(n-2)^{th}$ fraction. In some embodiments, at least 50 wt. %, such as at least 60 wt. %, at least 70 wt. %, at least 80 wt. %, at least 90 wt. %, at least 95 wt. %, at least 99 wt. %, from 50 wt. % to 100 wt. %, from 60 wt. % to 100 wt. %, from 70 wt. % to 100 wt. %, from 80 wt. % to 100 wt. %, from 90 wt. % to 100 wt. %, from 95 wt. % to 100 wt. %, or even from 99 wt. % to 100 wt. % of hydrocarbons in the $(n-1)^{th}$ fraction may boil at a temperature of between 260° C. and 316° C., based on the total weight of hydrocarbons in the $(n-1)^{th}$ fraction. In some embodiments, at least 50 wt. %, such as at least 60 wt. %, at least 70 wt. %, at least 80 wt. %, at least 90 wt. %, at least 95 wt. %, at least 99 wt. %, from 50 wt. % to 100 wt. %, from 60 wt. % to 100 wt. %, from 70 wt. % to 100 wt. %, from 80 wt. % to 100 wt. %, from 90 wt. % to 100 wt. %, from 95 wt. % to 100 wt. %, or even from 99 wt. % to 100 wt. % of hydrocarbons in the $n^{th}$ fraction may boil at a temperature of between 316° C. and 370° C., based on the total weight of hydrocarbons in the $n^{th}$ fraction.

Each fraction may have a greater concentration of sulfur than the fraction introduced to the hydroprocessing unit 106, 206 downstream of it. In embodiments, the $(n-2)^{th}$ fraction 102, 202 may have a greater concentration of sulfur than the $(n-1)^{th}$ fraction 110, 210. In embodiments, the $(n-1)^{th}$ fraction 110, 210 may have a greater concentration of sulfur than the $n^{th}$ fraction 116, 216.

The $(n-1)^{th}$ fraction 110, 210 may have a sulfur concentration of from 10% to 70%, such as from 10% to 60%, from 10% to 50%, from 10% to 40%, from 20% to 70%, from 20% to 60%, from 20% to 50%, from 20% to 40%, or any subset thereof, of a sulfur concentration of the $(n-2)^{th}$ fraction 102, 202.

The $n^{th}$ fraction 116, 216 may have a sulfur concentration of from 10% to 70%, such as from 10% to 60%, from 10% to 50%, from 10% to 40%, from 20% to 70%, from 20% to 60%, from 20% to 50%, from 20% to 40%, or any subset thereof, of a sulfur concentration of the $(n-1)^{th}$ fraction 110, 210.

Each fraction may have a greater concentration of nitrogen than the fraction introduced to the hydroprocessing unit 106, 206 downstream of it. In embodiments, the $(n-2)^{th}$ fraction 102, 202 may have a greater concentration of nitrogen than the $(n-1)^{th}$ fraction 110, 210. In embodiments, the $(n-1)^{th}$ fraction 110, 210 may have a greater concentration of nitrogen than the $n^{th}$ fraction 116, 216.

The $(n-1)^{th}$ fraction 110, 210 may have a nitrogen concentration of from 10% to 70%, such as from 10% to 60%, from 10% to 50%, from 10% to 40%, from 20% to 70%, from 20% to 60%, from 20% to 50%, from 20% to 40%, or any subset thereof, of a nitrogen concentration of the $(n-2)^{th}$ fraction 102, 202.

The $n^{th}$ fraction 116, 216 may have a nitrogen concentration of from 10% to 70%, such as from 10% to 60%, from 10% to 50%, from 10% to 40%, from 20% to 70%, from 20% to 60%, from 20% to 50%, from 20% to 40%, or any subset thereof, of a nitrogen concentration of the $(n-1)^{th}$ fraction 110, 210.

Each fraction may have a greater concentration of aromatic compounds than the fraction introduced to the hydroprocessing unit 106, 206 downstream of it. In embodiments, the $(n-2)^{th}$ fraction 102, 202 may have a greater concentration of aromatic compounds than the $(n-1)^{th}$ fraction 110, 210. In embodiments, the $(n-1)^{th}$ fraction 110, 210 may have a greater concentration of aromatic compounds than the $n^{th}$ fraction 116, 216.

The $(n-1)^{th}$ fraction 110, 210 may have a concentration of aromatic compounds of from 10% to 70%, such as from 10% to 60%, from 10% to 50%, from 10% to 40%, from 20% to 70%, from 20% to 60%, from 20% to 50%, from 20% to 40%, or any subset thereof, of a concentration of aromatic compounds of the $(n-2)^{th}$ fraction 102, 202.

The $n^{th}$ fraction 116, 216 may have a concentration of aromatic compounds of from 10% to 70%, such as from 10% to 60%, from 10% to 50%, from 10% to 40%, from 20% to 70%, from 20% to 60%, from 20% to 50%, from 20% to 40%, or any subset thereof, of a concentration of aromatic compounds of the $(n-1)^{th}$ fraction 110, 210.

Hydroprocessing the respective hydrocarbon feed fractions may comprise contacting the respective hydrocarbon feed fractions with a hydroprocessing catalyst, at a hydroprocessing temperature, a hydroprocessing pressure, under a hydroprocessing atmosphere, and at a hydroprocessing liquid hourly space velocity (LHSV). The hydroprocessing unit 106, 206 may be operated under hydrotreating conditions or hydrocracking conditions.

The hydroprocessing catalyst may comprise one or more metals from the International Union of Pure and Applied Chemistry (IUPAC) Groups 5, 6, or 8-10 of the periodic table. Example IUPAC Group 6 metals include molybdenum and tungsten. Example IUPAC Group 8-10 metals include nickel and cobalt. In one embodiment, the hydroprocessing catalyst may comprise molybdenum and nickel metal catalyst, cobalt and molybdenum metal catalyst, or both. The hydroprocessing catalyst may further comprise a support material, and the metal may be disposed on the support material. The support material may be gamma-alumina or silica/alumina extrudates, spheres, cylinders, beads, pellets, and combinations thereof.

The hydrocarbon feed fractions may contact the hydroprocessing catalyst in any hydroprocessing reactor, such as a moving bed reactor or a fixed bed reactor. In embodiments, the hydrocarbon feed fractions may contact the hydroprocessing catalyst in a fixed bed reactor.

The hydroprocessing pressure of each hydroprocessing reaction zone may be at least 10 bar. In embodiments, the hydroprocessing pressure may be at least 20 bar, at least 30 bar, at least 40 bar, from 10 bar to 200 bar, from 10 bar to 175 bar, from 10 bar 150 bar, from 10 bar to 125 bar, from 10 bar to 100 bar, from 10 bar to 75 bar, from 10 bar to 50 bar, from 25 bar to 200 bar, from 25 bar to 175 bar, from 25 bar to 150 bar, from 25 bar to 125 bar, from 25 bar to 100 bar, from 25 bar to 75 bar, from 25 bar to 50 bar, from 35 bar to 200 bar, from 35 bar to 150 bar, from 35 bar to 100 bar, from 35 bar to 50 bar, from 35 bar to 45 bar, or any subset thereof. It should be understood that in some embodiments, the hydroprocessing pressure may refer to an overall pressure and in some embodiments, the hydroprocessing pressure may refer to a partial pressure of hydrogen.

The atmosphere contacting the hydroprocessing catalyst in the hydroprocessing unit may be at least 90 mol. %, at least 95 mol. %, at least 99 mol. % or at least 99.99 mol. % of the combination of hydrocarbons, reaction products from the hydroprocessing process, and hydrogen. In embodiments, the atmosphere contacting the hydroprocessing catalyst in the hydroprocessing unit may comprise at least 90 mol. %, at least 95 mol. %, at least 99 mol. %, or even at least 99.9 mol. % of hydrogen, hydrogen sulfide, ammonia, methane, ethane, propane, and butanes.

Each hydroprocessing reaction zone may be operated with a greater hydrogen partial pressure than the one downstream of it. A hydrogen partial pressure in the $(n-1)^{th}$ hydroprocessing reaction 112, 212 zone may be less than a hydrogen partial pressure in the $(n-2)^{th}$ hydroprocessing reaction zone 104, 204. In embodiments, a hydrogen partial pressure in the $(n-1)^{th}$ hydroprocessing reaction zone 112, 212 may be at least 1 bar (100 kpa), such as at least 5 bar (500 kpa), at least 10 bar (1000 kpa), at least 20 bar (2000 kpa), at least 50 bar (5000 kpa), from 1 bar to 10 bar (100 kpa to 1000 kpa), or from 5 bar to 10 bar (500 kpa to 1000 kpa), less than a hydrogen partial pressure in the $(n-2)^{th}$ hydroprocessing reaction zone 104, 204. A hydrogen partial pressure of the $n^{th}$ hydroprocessing reaction zone 120, 220 may be less than the hydrogen partial pressure in the $(n-1)^{th}$ hydroprocessing reaction zone 112, 212. In embodiments, a hydrogen partial pressure in the $n^{th}$ hydroprocessing reaction zone 120, 220 may be at least 1 bar (100 kpa), such as at least 5 bar (500 kpa), at least 10 bar (1000 kpa), at least 20 bar (2000 kpa), at least 50 bar (5000 kpa), from 1 bar to 5 bar (100 kpa to 5000 kpa), from 5 bar to 10 bar (500 kpa to 1000 kpa), less than a hydrogen partial pressure in the $(n-1)^{th}$ hydroprocessing reaction zone 112, 212.

A hydrogen partial pressure in the $(n-2)^{th}$ hydroprocessing reaction zone 104, 204 may be from 2 bar to 200 bar (200 kpa to 20,000 kpa), such as from 10 bar to 200 bar (1,000 kpa to 20,000 kpa), from 20 bar to 200 bar (2,000 kpa to 20,000 kpa), from 30 bar to 200 bar (3,000 kpa to 20,000 kpa), from 2 bar to 150 bar (200 kpa to 15,000 kpa), from 10 bar to 150 bar (1,000 kpa to 15,000 kpa), from 20 bar to 150 bar (2,000 kpa to 15,000 kpa), from 30 bar to 150 bar (3,000 kpa to 15,000 kpa), from 20 bar to 60 bar (2000 kpa to 6000 kpa), from 25 bar to 60 bar (2500 kpa to 6000 kpa), from 30 bar to 60 bar (3000 kpa to 6000 kpa), from 35 bar to 60 bar (3500 kpa to 6000 kpa), from 20 bar to 55 bar (2000 kpa to 5500 kpa), from 20 bar to 50 bar (2000 kpa to 5000 kpa), from 20 bar to 45 bar (2000 kpa to 4500 kpa), from 25 bar to 55 bar (2500 kpa to 5500 kpa), from 30 bar to 50 bar (3000 kpa to 5000 kpa), from 35 bar to 45 bar (3500 kpa to 4500 kpa), or any subset thereof. A hydrogen partial pressure in the $(n-1)^{th}$ hydroprocessing reaction zone 112, 212 may be from 2 bar to 200 bar (200 kpa to 20,000 kpa), such as from 10 bar to 200 bar (1,000 kpa to 20,000 kpa), from 20 bar to 200 bar (2,000 kpa to 20,000 kpa), from 30 bar to 200 bar (3,000 kpa to 20,000 kpa), from 2 bar to 150 bar (200 kpa to 15,000 kpa), from 10 bar to 150 bar (1,000 kpa to 15,000 kpa), from 20 bar to 150 bar (2,000 kpa to 15,000 kpa), from 30 bar to 150 bar (3,000 kpa to 15,000 kpa), from 20 bar to 60 bar (2000 kpa to 6000 kpa), from 25 bar to 60 bar (2500 kpa to 6000 kpa), from 30 bar to 60 bar (3000 kpa to 6000 kpa), from 35 bar to 60 bar (3500 kpa to 6000 kpa), from 20 bar to 55 bar (2000 kpa to 5500 kpa), from 20 bar to 50 bar (2000 kpa to 5000 kpa), from 20 bar to 45 bar (2000 kpa to 4500 kpa), from 25 bar to 55 bar (2500 kpa to 5500 kpa), from 30 bar to 50 bar (3000 kpa to 5000 kpa), from 35 bar to 45 bar (3500 kpa to 4500 kpa), or any subset thereof. A hydrogen partial pressure in the $n^{th}$ hydroprocessing reaction zone 120, 220 may be from 2 bar to 200 bar (200 kpa to 20,000 kpa), such as from 10 bar to 200 bar (1,000 kpa to 20,000 kpa), from 20 bar to 200 bar (2,000 kpa to 20,000 kpa), from 30 bar to 200 bar (3,000 kpa to 20,000 kpa), from 2 bar to 150 bar (200 kpa to 15,000 kpa), from 10 bar to 150 bar (1,000 kpa to 15,000 kpa), from 20 bar to 150 bar (2,000 kpa to 15,000 kpa), from 30 bar to 150 bar (3,000 kpa to 15,000 kpa), 20 bar to 60 bar (2000 kpa to 6000 kpa), from 25 bar to 60 bar (2500 kpa to 6000 kpa), from 30 bar to 60 bar (3000 kpa to 6000 kpa), from 35 bar to 60 bar (3500 kpa to 6000 kpa), from 20 bar to 55 bar (2000 kpa to 5500 kpa), from 20 bar to 50 bar (2000 kpa to 5000 kpa), from 20 bar to 45 bar (2000 kpa to 4500 kpa), from 25 bar to 55 bar (2500 kpa to 5500 kpa), from 30 bar to 50 bar (3000 kpa to 5000 kpa), from 35 bar to 45 bar (3500 kpa to 4500 kpa), or any subset thereof.

A hydrogen partial pressure in the $(n-2)^{th}$ hydroprocessing reaction zone, such as the $1^{st}$ hydroprocessing reaction zone 104, 204, may be from 3 bar to 10 bar (300 kpa to 1000 kpa) more than the hydrogen partial pressure in the $(n-1)^{th}$ hydroprocessing reaction zone, such as the $2^{nd}$ hydroprocessing reaction zone. In embodiments, the hydrogen partial pressure in the $(n-1)^{th}$ hydroprocessing reaction zone 104, 204, such as the $2^{nd}$ hydroprocessing reaction zone, may be from 3 bar to 8 bar (300 kpa to 800 kpa), 3 bar to 6 bar (300 kpa to 600 kpa), 3 bar to 50 bar (300 kpa to 500 kpa), 5 bar to 10 bar (500 kpa to 1000 kpa), 7 bar to 10 bar (700 kpa to 1000 kpa), 9 bar to 10 bar (900 kpa to 1000 kpa), or any subset thereof, more than the hydrogen partial pressure in the $n^{th}$ hydroprocessing reaction zone, such as the $3^{rd}$ hydroprocessing reaction zone.

In some embodiments, such as 2-phase embodiments, it may be difficult to quantify the hydrogen partial pressure. In such embodiments, it may be preferable to quantify the pressure in the hydroprocessing reaction zone as the overall pressure, rather than a partial pressure.

Each hydroprocessing reaction zone may be operated with a greater overall pressure than the one downstream of it. In embodiments, an overall pressure in the $(n-1)^{th}$ hydroprocessing reaction 112, 212 zone may be less than an overall pressure in the $(n-2)^{th}$ hydroprocessing reaction zone 104, 204. In embodiments, an overall pressure in the $(n-1)^{th}$ hydroprocessing reaction zone 112, 212 may be at least 1 bar (100 kpa), such as at least 5 bar (500 kpa), at least 10 bar (1000 kpa), at least 20 bar (2000 kpa), at least 50 bar (5000 kpa), from 1 bar to 10 bar (100 kpa to 1000 kpa), or from 5 bar to 10 bar (500 kpa to 1000 kpa), less than an overall pressure in the $(n-2)^{th}$ hydroprocessing reaction zone 104, 204. An overall pressure of the $n^{th}$ hydroprocessing reaction zone 120, 220 may be less than the overall pressure in the $(n-1)^{th}$ hydroprocessing reaction zone 112, 212. In embodiments, an overall pressure in the $n^{th}$ hydroprocessing reaction zone 120, 220 may be at least 1 bar (100 kpa), such as at least 5 bar (500 kpa), at least 10 bar (1000 kpa), at least 20 bar (2000 kpa), at least 50 bar (5000 kpa), from 1 bar to 5 bar (100 kpa to 5000 kpa), from 5 bar to 10 bar (500 kpa to 1000 kpa), less than an overall pressure in the $(n-1)^{th}$ hydroprocessing reaction zone 112, 212.

An overall pressure in the $(n-2)^{th}$ hydroprocessing reaction zone 104, 204 may be from 2 bar to 200 bar (200 kpa to 20,000 kpa), such as from 10 bar to 200 bar (1,000 kpa to 20,000 kpa), from 20 bar to 200 bar (2,000 kpa to 20,000 kpa), from 30 bar to 200 bar (3,000 kpa to 20,000 kpa), from 2 bar to 150 bar (200 kpa to 15,000 kpa), from 10 bar to 150 bar (1,000 kpa to 15,000 kpa), from 20 bar to 150 bar (2,000 kpa to 15,000 kpa), from 30 bar to 150 bar (3,000 kpa to 15,000 kpa), from 20 bar to 60 bar (2000 kpa to 6000 kpa), from 25 bar to 60 bar (2500 kpa to 6000 kpa), from 30 bar to 60 bar (3000 kpa to 6000 kpa), from 35 bar to 60 bar (3500 kpa to 6000 kpa), from 20 bar to 55 bar (2000 kpa to 5500 kpa), from 20 bar to 50 bar (2000 kpa to 5000 kpa), from 20 bar to 45 bar (2000 kpa to 4500 kpa), from 25 bar to 55 bar (2500 kpa to 5500 kpa), from 30 bar to 50 bar (3000 kpa to 5000 kpa), from 35 bar to 45 bar (3500 kpa to 4500 kpa), or any subset thereof. An overall pressure in the $(n-1)^{th}$ hydroprocessing reaction zone 112, 212 may be from 2 bar to 200 bar (200 kpa to 20,000 kpa), such as from 10 bar to 200 bar (1,000 kpa to 20,000 kpa), from 20 bar to 200 bar (2,000 kpa to 20,000 kpa), from 30 bar to 200 bar (3,000 kpa to 20,000 kpa), from 2 bar to 150 bar (200 kpa to 15,000 kpa), from 10 bar to 150 bar (1,000 kpa to 15,000 kpa), from 20 bar to 150 bar (2,000 kpa to 15,000 kpa), from 30 bar to 150 bar (3,000 kpa to 15,000 kpa), from 20 bar to 60 bar (2000 kpa to 6000 kpa), from 25 bar to 60 bar (2500 kpa to 6000 kpa), from 30 bar to 60 bar (3000 kpa to 6000 kpa), from 35 bar to 60 bar (3500 kpa to 6000 kpa), from 20 bar to 55 bar (2000 kpa to 5500 kpa), from 20 bar to 50 bar (2000 kpa to 5000 kpa), from 20 bar to 45 bar (2000 kpa to 4500 kpa), from 25 bar to 55 bar (2500 kpa to 5500 kpa), from 30 bar to 50 bar (3000 kpa to 5000 kpa), from 35 bar to 45 bar (3500 kpa to 4500 kpa), or any subset thereof. An overall pressure in the $n^{th}$ hydroprocessing reaction zone 120, 220 may be from 2 bar to 200 bar (200 kpa to 20,000 kpa), such as from 10 bar to 200 bar (1,000 kpa to 20,000 kpa), from 20 bar to 200 bar (2,000 kpa to 20,000 kpa), from 30 bar to 200 bar (3,000 kpa to 20,000 kpa), from 2 bar to 150 bar (200 kpa to 15,000 kpa), from 10 bar to 150 bar (1,000 kpa to 15,000 kpa), from 20 bar to 150 bar (2,000 kpa to 15,000 kpa), from 30 bar to 150 bar (3,000 kpa to 15,000 kpa), from 20 bar to 60 bar (2000 kpa to 6000 kpa), from 25 bar to 60 bar (2500 kpa to 6000 kpa), from 30 bar to 60 bar (3000 kpa to 6000 kpa), from 35 bar to 60 bar (3500 kpa to 6000 kpa), from 20 bar to 55 bar (2000 kpa to 5500 kpa), from 20 bar to 50 bar (2000 kpa to 5000 kpa), from 20 bar to 45 bar (2000 kpa to 4500 kpa), from 25 bar to 55 bar (2500 kpa to 5500 kpa), from 30 bar to 50 bar (3000 kpa to 5000 kpa), from 35 bar to 45 bar (3500 kpa to 4500 kpa), or any subset thereof.

An overall pressure in the $(n-2)^{th}$ hydroprocessing reaction zone, such as the $1^{st}$ hydroprocessing reaction zone 104, 204, may be from 3 bar to 10 bar (300 kpa to 1000 kpa), such as from 3 bar to 8 bar (300 kpa to 800 kpa), 3 bar to 6 bar (300 kpa to 600 kpa), 3 bar to 50 bar (300 kpa to 500 kpa), 5 bar to 10 bar (500 kpa to 1000 kpa), 7 bar to 10 bar (700 kpa to 1000 kpa), 9 bar to 10 bar (900 kpa to 1000 kpa), or more than the overall pressure in the $(n-1)^{th}$ hydroprocessing reaction zone, such as the $2^{nd}$ hydroprocessing reaction zone.

In embodiments, an overall pressure in the $(n-1)^{th}$ hydroprocessing reaction zone 104, 204, such as the $2^{nd}$ hydroprocessing reaction zone, may be from 3 bar to 10 bar (300 kpa to 1000 kpa), such as from 3 bar to 8 bar (300 kpa to 800 kpa), 3 bar to 6 bar (300 kpa to 600 kpa), 3 bar to 50 bar (300 kpa to 500 kpa), 5 bar to 10 bar (500 kpa to 1000 kpa), 7 bar to 10 bar (700 kpa to 1000 kpa), 9 bar to 10 bar (900 kpa to 1000 kpa), or any subset thereof, more than the overall pressure in the $n^{th}$ hydroprocessing reaction zone, such as the $3^{rd}$ hydroprocessing reaction zone.

An inlet temperature of each hydroprocessing reaction zone may be the same or substantially the same all other hydroprocessing reaction zones. In embodiments, all hydroprocessing reaction zones may have an inlet temperature within 1° C., 2.5° C., 5° C., 10° C., 15° C., 25° C., or 40° C. of one another. In embodiments, an inlet temperature of the $(n-2)^{th}$ hydroprocessing reaction zone 104, 204 may be the same or substantially the same as an inlet temperature of the $(n-1)^{th}$ hydroprocessing reaction zone 112, 212 and an inlet temperature of the $n^{th}$ hydroprocessing reaction zone 120, 220. In embodiments, an inlet temperature of the $(n-2)^{th}$ hydroprocessing reaction zone 104, 204 may be within 1° C., 2.5° C., 5° C., 10° C., 15° C., 25° C., or 40° C. of an inlet temperature of the $(n-1)^{th}$ hydroprocessing reaction zone 112, 212 and an inlet temperature of the $n^{th}$ hydroprocessing reaction zone 120, 220.

An inlet temperature of each hydroprocessing reaction zone may be different from each other hydroprocessing reaction zone. An inlet temperature of the $(n-2)^{th}$ hydroprocessing reaction zone 104, 204 may be different from each of an inlet temperature of the $(n-1)^{th}$ hydroprocessing reaction zone 112, 212 and an inlet temperature of the $n^{th}$ hydroprocessing reaction zone 120, 220. In embodiments, an inlet temperature of the $(n-2)^{th}$ hydroprocessing reaction zone 104, 204 may be at least 1° C., such as from 1° C. to 20° C., from 1° C. to 15° C., from 1° C. to 10° C., from 5° C. to 20° C., from 10° C. to 20° C., or any subset thereof, different from (such as greater than) an inlet temperature of the $(n-1)^{th}$ hydroprocessing reaction zone 112, 212. In embodiments, an inlet temperature of the $(n-1)^{th}$ hydroprocessing reaction zone 112, 212 may be at least 1° C., such as from 1° C. to 20° C., from 1° C. to 15° C., from 1° C. to 10° C., from 5° C. to 20° C., from 10° C. to 20° C., or any subset thereof, different from (such as greater than) an inlet temperature of the $n^{th}$ hydroprocessing reaction zone 120, 220.

An inlet temperature of the $(n-2)^{th}$ hydroprocessing reaction zone 104, 204 may be from 350° C. to 390° C. In embodiments, the inlet temperature of the $(n-2)^{th}$ hydroprocessing reaction zone 104, 204 may be from 360° C. to 390° C., from 370° C. to 390° C., from 380° C. to 390° C., from 350° C. to 380° C., from 350° C. to 370° C., from 350° C. to 360° C., from 360° C. to 380° C., from 365° C. to 375° C., or any subset thereof.

An inlet temperature of the $(n-1)^{th}$ hydroprocessing reaction zone 112, 212 may be from 360° C. to 400° C. In embodiments, the inlet temperature of the $(n-1)^{th}$ hydroprocessing reaction zone 112, 212 may be from 370° C. to 400° C., from 380° C. to 400° C., from 390° C. to 400° C., from 360° C. to 390° C., from 360° C. to 380° C., from 360° C. to 370° C., from 370° C. to 390° C., from 375° C. to 385° C., or any subset thereof.

An inlet temperature of the $n^{th}$ hydroprocessing reaction zone 120, 220 may be from 370° C. to 410° C. In embodiments, the inlet temperature of the $n^{th}$ hydroprocessing reaction zone 120, 220 may be from 380° C. to 410° C., from 390° C. to 410° C., from 400° C. to 410° C., from 370° C. to 400° C., from 370° C. to 390° C., from 370° C. to 380° C., from 380° C. to 400° C., from 385° C. to 390° C., or any subset thereof.

Without being limited by theory, it is believed that increasing inlet temperatures as the feed moves downstream through the reaction zones may be helpful or even necessary to crack the most refractory sulfur containing compounds.

Temperature profiles of each hydroprocessing reaction zone may not be isothermal. In embodiments, temperature profiles of each of the $(n-2)^{th}$ hydroprocessing reaction zone 104, 204, the $(n-1)^{th}$ hydroprocessing reaction zone 112, 212, and the $n^{th}$ hydroprocessing reaction zone 120, 220 may independently not be isothermal. In embodiments, each hydroprocessing reaction zone may independently have a temperature delta from inlet to outlet of from 5° C. to 50° C., such as from 5° C. to 45° C., from 5° C. to 40° C., from 5° C. to 35° C., from 5° C. to 30° C., from 5° C. to 25° C., from 5° C. to 20° C., from 5° C. to 15° C., from 10° C. to 50° C., from 10° C. to 45° C., from 10° C. to 40° C., from 10° C. to 35° C., from 10° C. to 30° C., from 10° C. to 25° C., from 10° C. to 15° C., from 15° C. to 50° C., from 15° C. to 45° C., from 15° C. to 40° C., from 15° C. to 35° C., from 15° C. to 30° C., from 15° C. to 25° C., from 20° C. to 50° C., from 20° C. to 45° C., from 20° C. to 40° C., from 20° C. to 35° C., from 20° C. to 30° C., from 25° C. to 50° C., from 25° C. to 45° C., from 25° C. to 40° C., from 25° C. to 35° C., from 30° C. to 50° C., from 30° C. to 45° C., from 30° C. to 35° C., or any subset thereof. Without being limited by theory, it is believed that non-isothermal reaction zones, such as reaction zones with the above listed temperature delta ranges, may provide heat to the feedstock added to the next reaction zone.

A temperature differential across each of the $(n-2)^{th}$ hydroprocessing reaction zone 104, 204, the $(n-1)^{th}$ hydroprocessing reaction zone 112, 212, and the $n^{th}$ hydroprocessing reaction zone 120, 220 may independently be less than 40° C., such as less than 35° C., less than 30° C., less than 25° C., less than 20° C., or less than 15° C. Without being limited by theory, it is believed that an excessive temperature differential, such as one greater than 40° C. or greater than 15° C. may cause hot spots in the reactor or may even cause runaway reactions.

The hydroprocessing temperature, such as a weighted average bed temperature (WABT), of each hydroprocessing reaction zone of the hydroprocessing unit may be from 200° C. to 450° C. In embodiments, a WABT of each hydroprocessing reaction zone of the hydroprocessing unit may be from 200° C. to 400° C., from 200° C. to 350° C., from 200° C. to 300° C., from 250° C. to 450° C., from 300° C. to 450° C., from 350° C. to 450° C., from 300° C. to 350° C., from 325° C. to 340° C., or any subset thereof.

A LHSV of each hydroprocessing reaction zone in the hydroprocessing unit may be from 0.1 $h^{-1}$ to 10 $h^{-1}$. In embodiments, a LHSV of each hydroprocessing reaction zone in the hydroprocessing unit may be from 0.1 $h^{-1}$ to 10 $h^{-1}$, from 0.5 $h^{-1}$ to 10 $h^{-1}$, from 1 $h^{-1}$ to 10 $h^{-1}$, from 2.5 $h^{-1}$ to 10 $h^{-1}$, from 5 $h^{-1}$ to 10 $h^{-1}$, from 7.5 $h^{-1}$ to 10 $h^{-1}$, from 0.1 $h^{-1}$ to 7.5 $h^{-1}$, from 0.1 $h^{-1}$ to 5 $h^{-1}$ or any subset thereof.

Each hydroprocessing reaction zone may be operated with a lesser liquid hourly space velocity (LHSV) than the one directly upstream of it. In embodiments, each hydroprocessing reaction zone may be operated with a LHSV of from 10% to 50%, such as from 10% to 45%, from 10% to 40%, from 20% to 50%, from 20% to 45%, from 20% to 40%, from 30% to 50%, from 30% to 40%, or any subset thereof, of a LHSV of the hydroprocessing reaction zone directly upstream of it.

The $(n-2)^{t}$h hydroprocessing reaction zone 104, 204, such as the first hydroprocessing reaction zone, may be operated with an LHSV of from 5 $h^{-1}$ to 10 $h^{-1}$. In embodiments, the $(n-2)^{th}$ hydroprocessing reaction zone 104, 204 may be operated with an LHSV of from 5 $h^{-1}$ to 9 $h^{-1}$, 5 $h^{-1}$ to 8 $h^{-1}$, 5 $h^{-1}$ to 7 $h^{-1}$, 5 $h^{-1}$ to 6 $h^{-1}$, 6 $h^{-1}$ to 10 $h^{-1}$, 7 $h^{-1}$ to 10 $h^{-1}$, 8 $h^{-1}$ to 10 $h^{-1}$, 9 $h^{-1}$ to 10 $h^{-1}$, 6 $h^{-1}$ to 9 $h^{-1}$, 7 $h^{-1}$ to 8 $h^{-1}$, or any subset thereof.

The $(n-1)^{th}$ hydroprocessing reaction zone 112, 212 may be operated with a lesser liquid hourly space velocity (LHSV) than the $(n-2)^{th}$ hydroprocessing reaction zone 104, 204. In embodiments, the $(n-1)^{th}$ hydroprocessing reaction zone 112, 212 may be operated with a LHSV of from 10% to 50%, such as from 10% to 45%, from 10% to 40%, from 20% to 50%, from 20% to 45%, from 20% to 40%, from 30% to 50%, from 30% to 40%, or any subset thereof, of a LHSV of the $(n-2)^{th}$ hydroprocessing reaction zone 104, 204.

The $(n-1)^{th}$ hydroprocessing reaction zone 112, 212, such as the $2^{nd}$ hydroprocessing reaction zone 104, 204, may be operated with an LHSV of from 2 $h^{-1}$ to 5 $h^{-1}$. In embodiments, the $(n-1)^{th}$ hydroprocessing reaction zone 112, 212 may be operated with an LHSV of from 2 $h^{-1}$ to 4 $h^{-1}$, from 2 $h^{-1}$ to 3 $h^{-1}$, from 3 $h^{-1}$ to 5 $h^{-1}$, from 4 $h^{-1}$ to 5 $h^{-1}$, or any subset thereof.

The $n^{th}$ hydroprocessing reaction zone 120, 220 may be operated with a lesser LHSV than the $(n-1)^{th}$ hydroprocessing reaction zone 112, 212. In embodiments, the $n^{th}$ hydroprocessing reaction zone 120, 220 may be operated with a LHSV of from 10% to 50%, such as from 10% to 45%, from 10% to 40%, from 20% to 50%, from 20% to 45%, from 20% to 40%, from 30% to 50%, from 30% to 40%, or any subset thereof, of a LHSV of the $(n-1)^{th}$ hydroprocessing reaction zone 112, 212.

The $n^{th}$ hydroprocessing reaction zone 120, 220, such as the $3^{rd}$ hydroprocessing reaction zone, may be operated with an LHSV of from 0.1 $h^{-1}$ to 2 $h^{-1}$. In embodiments, the $n^{th}$ hydroprocessing reaction zone 120, 220 may be operated with an LHSV of from 0.1 $h^{-1}$ to 1.5 $h^{-1}$, from 0.1 $h^{-1}$ to 1 $h^{-1}$, from 0.1 $h^{-1}$ to 0.5 $h^{-1}$, from 0.1 $h^{-1}$ to 0.25 $h^{-1}$, from 0.25 $h^{-1}$ to 2 $h^{-1}$, from 0.25 $h^{-1}$ to 1.5 $h^{-1}$, from 0.25 $h^{-1}$ to 1 $h^{-1}$, from 0.5 $h^{-1}$ to 2 $h^{-1}$, from 0.5 $h^{-1}$ to 1.2 $h^{-1}$, from 0.5 $h^{-1}$ to 1 $h^{-1}$, from 0.75 $h^{-1}$ to 2 $h^{-1}$, from 0.75 $h^{-1}$ to 1.5 $h^{-1}$, from 0.75 $h^{-1}$ to 1 $h^{-1}$, from 0.8 $h^{-1}$ to 1 $h^{-1}$, from 1 $h^{-1}$ to 2 $h^{-1}$, from 1.5 $h^{-1}$ to 2 $h^{-1}$, from 0.5 $h^{-1}$ to 1.5 $h^{-1}$, or any subset thereof.

A hydroprocessing volumetric hydrogen/oil ratio may be from 800:1 to 1500:1, such as from 900:1 to 1500:1, from 1000:1 to 1500:1 from 1100:1 to 1500:1, from 1200:1 to 1500:1, from 800:1 to 1400:1, from 800:1 to 1300:1, from 800:1 to 1200:1, or any subset thereof.

In some embodiments, the hydroprocessing unit may be a conventional hydroprocessing unit wherein hydrogen gas and the hydrocarbon feed are in countercurrent flow in the hydroprocessing unit. In such embodiments, gaseous hydrogen may be provided to the bottom 128 of the hydroprocessing unit 106 and hydrocarbons may be provided to at least the top of the hydroprocessing unit 130. The hydrogen may then flow upwards from the bottom 128 of the hydroprocessing unit 106 to the top 130 of the hydroprocessing unit 106 while the hydrocarbons flow to the bottom 128 of the hydroprocessing unit 106.

In embodiments, the hydrogen and hydrocarbons may be in co-current flow in the hydroprocessing unit. In such embodiments, both hydrogen and hydrocarbons may be provided to the hydroprocessing unit 106 at the same point, such as at the top 130 of the hydroprocessing unit 106. It should be understood that co-current flow embodiments may include embodiments where the hydrogen is supplied as a gas (three-phase systems) and embodiments where the hydrogen is dissolved in the hydrocarbons (two-phase systems). The hydrogen may then flow with the hydrocarbons through the hydroprocessing unit 106. Without being limited by theory, it is believed that the use of co-current flow may produce an elevated hydrogen content at the inlet to the first reactions zones, relative to a counter-current flow system. This elevated hydrogen content may result in increased reaction rates.

The hydroprocessing unit may be a two-phase system wherein hydrogen gas is dissolved in the hydrocarbon feed. The two phases being the liquid phase (which includes the dissolved hydrogen) and the solid phase (the catalyst).

In two-phase embodiments, at least 50 mol. %, such as from 50 mol. % to 100 mol. %, from 60 mol. % to 100 mol. %, from 70 mol. % to 100 mol. %, from 80 mol. % to 100 mol. %, from 90 mol. % to 100 mol. %, from 95 mol. % to 100 mol. %, or even from 99 mol. % to 100 mol. %, of the hydrogen supplied to each of the hydroprocessing reaction zones may be provided by hydrogen dissolved in the hydrocarbon feed fractions. In embodiments, no gaseous hydrogen may be supplied to the hydroprocessing reaction zones in the hydroprocessing unit 106. It should be understood that hydrogen may be supplied to the hydroprocessing unit and dissolved into the hydrocarbon feed fractions before their introduction into their respective hydroprocessing reaction zones. It should be further understood that the hydrocarbon streams may have additional hydrogen dissolved in them between hydroprocessing reaction zones.

The hydrocarbon feed fractions may each comprise dissolved hydrogen. Accordingly, each of the $(n-2)^{th}$ fraction 102, 202 the $(n-1)^{th}$ fraction 110, 210 and the $n^{th}$ fraction 116, 216 may independently comprise dissolved hydrogen. In embodiments, each of the $(n-2)^{th}$ fraction 102, 202 the $(n-1)^{th}$ fraction 110, 210 and the $n^{th}$ fraction 116, 216 may independently be saturated with dissolved hydrogen before their introduction into their respective hydroprocessing reaction zones.

Still referring to FIG. 1, the method 100 may comprise mixing the fresh hydrocarbon feed fractions with the streams of hydroprocessed effluents in mixing zones. In embodiments, the $(n-1)^{th}$ fraction 110 may be mixed with the $(n-2)^{th}$ effluent in an $(n-2)^{th}$ mixing zone 124. In embodiments, the $n^{th}$ fraction 116 may be mixed with the $(n-1)^{th}$ effluent in a $(n-1)^{th}$ mixing zone 126.

The mixing zones may comprise empty reactor space (such as space without catalyst, baffles, spargers, bubblers, or other mixing devices) or may comprise mixing devices such as baffles. Without being limited by theory, it is believed that the mixing of fresh hydrocarbon feed fractions with the streams of hydroprocessed effluent in the mixing zone may serve to lower the temperature of the hydroprocessed effluent. This reduction in temperature may reduce or even eliminate the need for quench gas and the associated quench zones.

The fresh hydrocarbon feeds may be mixed with the hydroprocessed effluents in mixing zones downstream, such as at the bottom, of each prior catalyst bed. In embodiments, the $(n-1)^{th}$ fraction 110 may be mixed with the $(n-2)^{th}$ effluent in the $(n-2)^{th}$ mixing zone 124 at the bottom of the $(n-2)^{th}$ catalyst bed (which resides in the $(n-2)^{th}$ hydroprocessing reaction zone 104), thereby forming a $(n-1)^{th}$ feed. The $(n-1)^{th}$ feed may have a temperature of at least 5° C., at least 10° C., at least 15° C., at least 20° C., from 5° C. to 40° C., from 10° C. to 40° C., from 15° C. to 40° C., or any subset thereof, lower than the $(n-2)^{th}$ effluent had as the $(n-2)^{th}$ effluent exited the $(n-2)^{th}$ catalyst bed. In embodiments, the $n^{th}$ fraction 116 may be mixed with the $(n-1)^{th}$ effluent in the $(n-1)^{th}$ mixing zone 126, at the bottom of the $(n-1)^{th}$ catalyst bed (which resides in the $(n-1)^{th}$ hydroprocessing reaction zone 112), thereby forming a $n^{th}$ feed. The $n^{th}$ feed may have a temperature of at least 5° C., at least 10° C., at least 15° C., at least 20° C., from 5° C. to 40° C., from 10° C. to 40° C., from 15° C. to 40° C., or any subset thereof, lower than the $(n-1)^{th}$ effluent had as the $(n-1)^{th}$ effluent exited the $(n-1)^{th}$ catalyst bed.

The method 100 may comprise feeding minimal quench gas to the hydroprocessing unit. In embodiments, the mass of quench gas fed to the hydroprocessing unit may be less than 10 wt. %, less than 5 wt. %, less than 2.5 wt. %, less than 1 wt. %, less than 0.1 wt. %, less than 0.01 wt. %, less than 0.001 wt. %, or even less than 0.00001 wt. %, or even less than 0.0000001 wt. % of the mass of the hydrocarbon feed. The quench gas may comprise a recycle stream, which may comprise one or more of hydrogen gas, hydrogen sulfide, and $C_1$ to $C_4$ hydrocarbons. The quench gas may comprise hydrogen gas. In embodiments, quench gas may refer to the provision of hydrogen gas in excess of the quantity required to maintain the hydrogen partial pressure after the hydroprocessing reactions occur.

In embodiments, the hydroprocessing unit 106 may not comprise quench zones. Quench zones may comprise gas-liquid mixing equipment, such as spargers, injection nozzles, or other devices which impart sufficient velocity to inject the hydrogen gas into the liquid hydrocarbon, thereby promoting turbulent gas-liquid mixing.

The method 100 of hydroprocessing a hydrocarbon feed may reduce the heteroatom content of the hydrocarbon feed, the aromatic content of the hydrocarbon feed, the molecular weight of the hydrocarbons in the hydrocarbon feed, or a combination of these. In embodiments, the method of hydroprocessing a hydrocarbon feed may reduce the content of at least one heteroatom, such as sulfur, nitrogen, oxygen, and metals, in the hydrocarbon feed by at least 5%, such as at least 10%, at 15%, at least 20%, at least 25%, at least 30%, at least 35%, at least 40%, at least 45%, at least 50%, at least 55%, at least 60%, at least 75%, at least 80%, at least 85%, at least 90%, at least 95%, at least 99%, at least 99.9%, at least 99.99%, at least 99.999%, at least 99.9999%, or even at least 99.99999%.

The method 100 of hydroprocessing a hydrocarbon feed may reduce the content of sulfur in the hydrocarbon feed by at least 5%, such as at least 10%, at 15%, at least 20%, at least 25%, at least 30%, at least 35%, at least 40%, at least 45%, at least 50%, at least 55%, at least 60%, at least 75%, at least 80%, at least 85%, at least 90%, at least 95%, at least 99%, at least 99.9%, at least 99.99%, at least 99.999%, at least 99.9999%, or even at least 99.99999%. The method of hydroprocessing the hydrocarbon feed may reduce the content of sulfur in the $n^{th}$ effluent to less than or equal to 10 parts per million by weight (ppmw).

The method 100 of hydroprocessing a hydrocarbon feed may reduce the content of nitrogen in the hydrocarbon feed by at least 5%, such as at least 10%, at 15%, at least 20%, at least 25%, at least 30%, at least 35%, at least 40%, at least 45%, at least 50%, at least 55%, at least 60%, at least 75%, at least 80%, at least 85%, at least 90%, at least 95%, at least 99%, at least 99.9%, at least 99.99%, at least 99.999%, at least 99.9999%, or even at least 99.99999%. The method of hydroprocessing the hydrocarbon feed may reduce the content of nitrogen in the $n^{th}$ effluent to less than or equal to 10 parts per million by weight (ppmw).

The method 100 of hydroprocessing a hydrocarbon feed may reduce the molecular weight of the hydrocarbons in the hydrocarbon feed such that they are within the distillate fuel range. In embodiments, the method of hydroprocessing a hydrocarbon feed may reduce the molecular weight of the hydrocarbons in the hydrocarbon feed such that at least 50 wt. %, at least 65 wt. %, at least 70 wt. %, at least 80 wt. %, or even at least 90 wt. % of the hydrocarbons in the $n^{th}$ effluent boil from 30° C. to 70° C.

Aspects

According to a first aspect of the present disclosure, a method of hydroprocessing a hydrocarbon feed may comprise fractionating the hydrocarbon feed into "n" fractions, wherein "n" may be at least 2; hydroprocessing an $(n-1)^{th}$ fraction of the hydrocarbon feed in an (n−1)th hydroprocessing reaction zone of a hydroprocessing unit, thereby producing an $(n-1)^{th}$ effluent; and hydroprocessing the $n^{th}$ fraction and the (n−1) effluent in an $n^{th}$ hydroprocessing reaction zone, thereby producing an $n^{th}$ effluent; wherein the $(n-1)^{th}$ hydroprocessing reaction zone may be upstream of the $n^{th}$ hydroprocessing reaction zone; the $(n-1)^{th}$ fraction may have a greater boiling point range than the $n^{th}$ fraction; and hydrogen and the hydrocarbon feed may be in co-current flow in the hydroprocessing unit.

According to a second aspect of the present disclosure, in conjunction with the first aspect, "n" may be at least 3; the method may further comprise hydroprocessing an $(n-2)^{th}$ fraction of the hydrocarbon feed in an $(n-2)^{th}$ hydroprocessing reaction zone of a hydroprocessing unit, thereby producing an $(n-2)^{th}$ effluent; wherein hydroprocessing the $(n-1)^{th}$ fraction of the hydrocarbon feed may occur in conjunction with the $(n-2)^{th}$ effluent, thereby producing the $(n-1)^{th}$ effluent; the $(n-2)^{th}$ hydroprocessing reaction zone may be upstream of the $(n-1)^{th}$ hydroprocessing reaction zone; and the $(n-2)^{th}$ fraction may have a greater boiling point range than the $(n-1)^{th}$ fraction.

According to a third aspect the present disclosure, in conjunction with the first or second aspects, a method of hydroprocessing a hydrocarbon feed may comprise fractionating the hydrocarbon feed into "n" fractions, wherein "n" is at least 3; hydroprocessing an $(n-2)^{th}$ fraction of the hydrocarbon feed in an $(n-2)^{th}$ hydroprocessing reaction zone of a hydroprocessing unit, thereby producing an $(n-2)^{th}$ effluent; hydroprocessing an $(n-1)^{th}$ fraction of the hydrocarbon feed and the $(n-2)^{th}$ effluent in an $(n-1)^{th}$ hydroprocessing reaction zone of a hydroprocessing unit, thereby producing an $(n-1)^{th}$ effluent; and hydroprocessing the $n^{th}$ fraction and the $(n-1)^{th}$ effluent in an $n^{th}$ hydroprocessing reaction zone, thereby producing an $n^{th}$ effluent. The (n−2)th hydroprocessing reaction zone may be upstream of the $(n-1)^{th}$ hydroprocessing reaction zone and the $(n-1)^{th}$ hydroprocessing reaction zone may be upstream of the $n^{th}$ hydroprocessing reaction zone. The $(n-2)^{th}$ fraction may have a greater boiling point range than the $(n-1)^{th}$ fraction and the $(n-1)^{th}$ fraction may have a greater boiling point range than the $n^{th}$ fraction. Hydrogen and the hydrocarbon feed may be in co-current flow in the hydroprocessing unit.

According to a fourth aspect of the present disclosure, in conjunction with any of aspects 1-3, each of the $(n-1)^{th}$ fraction and the $n^{th}$ fraction may independently comprise dissolved hydrogen before being introduced to their respective hydroprocessing reaction zones.

According to a fifth aspect of the present disclosure, in conjunction with any of aspects 1-4, no gaseous hydrogen may be provided to the hydroprocessing reaction zones.

According to a sixth aspect of the present disclosure, in conjunction with any of aspects 1-5, no quench gas or liquid, other than the hydrocarbon feed fractions, may be introduced into the hydroprocessing unit.

According to a seventh aspect of the present disclosure, in conjunction with any of aspects 1-6, the hydrocarbon feed may comprise a crude oil fraction.

According to an eighth aspect of the present disclosure, in conjunction with any of aspects 1-7, the hydrocarbon feed may comprise a crude oil fraction and at least 50 wt. % of hydrocarbons in the hydrocarbon feed may boil at a temperature of between 180° C. and 370° C., based on the total weight of hydrocarbons in the hydrocarbon feed.

According to a ninth aspect of the present disclosure, in conjunction with any of aspects 1-8, the hydrocarbon feed may comprise a crude oil fraction; at least 50 wt. % of hydrocarbons in the hydrocarbon feed may boil at a temperature of between 180° C. and 370° C., based on the total weight of hydrocarbons in the hydrocarbon feed; n may be equal to 3; at least 50 wt. % of hydrocarbons in the $(n-2)^{th}$ fraction may boil at a temperature of between 180° C. and 260° C., based on the total weight of hydrocarbons in the $(n-2)^{th}$ fraction; at least 50 wt. % of hydrocarbons in the $(n-1)^{th}$ fraction may boil at a temperature of between 260° C. and 316° C., based on the total weight of hydrocarbons in the $(n-1)^{th}$ fraction; and at least 50 wt. % of hydrocarbons in the $n^{th}$ fraction may boil at a temperature of between 316° C. and 370° C., based on the total weight of hydrocarbons in the $n^{th}$ fraction.

According to a tenth aspect of the present disclosure, in conjunction with any of aspects 1-9, the method of hydroprocessing the hydrocarbon feed may reduce a heteroatom content of the hydrocarbon feed, reduce an aromatic content of the hydrocarbon feed, reduce a molecular weight of the hydrocarbons in the hydrocarbon feed, or a combination of these.

According to an eleventh aspect of the present disclosure, in conjunction with any of aspects 1-10. the $(n-1)^{th}$ hydroprocessing reaction zone may be operated with a greater LHSV than the $n^{th}$ hydroprocessing reaction zone.

According to a twelfth aspect of the present disclosure, in conjunction with any of aspects 1-11, an inlet temperature of the $(n-1)^{th}$ hydroprocessing reaction zone may be different from an inlet temperature of the $n^{th}$ hydroprocessing reaction zone.

According to a thirteenth aspect of the present disclosure, in conjunction with any of aspects 1-12, temperature profiles of each of the $(n-2)^{th}$ hydroprocessing reaction zone, the $(n-1)^{th}$ hydroprocessing reaction zone, and the $n^{th}$ hydroprocessing reaction zone may independently not be isothermal.

According to a fourteenth aspect of the present disclosure, in conjunction with any of aspects 1-13, a hydrogen partial pressure in the in each of the $(n-2)^{th}$ hydroprocessing reaction zones, the $(n-1)^{th}$ hydroprocessing reaction zones, and the $n^{th}$ hydroprocessing reaction zone may independently be from 10 bar to 200 bar.

According to a fifteenth aspect of the present disclosure, in conjunction with any of aspects 1-14, a hydrogen partial pressure of the $n^{th}$ hydroprocessing reaction zone may be less than the hydrogen partial pressure in the $(n-1)^{th}$ hydroprocessing reaction zone.

According to a sixteenth aspect of the present disclosure, in conjunction with any of aspects 1-15, a weighted average bed temperature (WABT) temperature of each hydroprocessing reaction zone of the hydroprocessing unit may be from 200° C. to 450° C.

According to a seventeenth aspect of the present disclosure, in conjunction with any of aspects 2-16, an LHSV of each of the $(n-2)^{th}$ hydroprocessing reaction zones, the $(n-1)^{th}$ hydroprocessing reaction zones, and the $n^{th}$ hydroprocessing reaction zone may be independently from 0.1 $h^{-1}$ to 10 $h^{-1}$.

According to an eighteenth aspect of the present disclosure, in conjunction with any of aspects 1-17, the $n^{th}$ effluent may comprise less than 10 parts per million by weight (ppmw) of sulfur and less than 10 ppmw of nitrogen.

According to a nineteenth aspect of the present disclosure, in conjunction with any of aspects 2-18, a temperature differential across each of the $(n-2)^{th}$ hydroprocessing reaction zone, the $(n-1)^{th}$ hydroprocessing reaction zone, and the $n^{th}$ hydroprocessing reaction zone may be independently less than 40° C.

According to a twentieth aspect of the present disclosure, in conjunction with any of aspects 1-19, wherein the hydroprocessing unit may comprise mixing zones.

According to a twenty-first aspect of the present disclosure, in conjunction with any of aspects 1-20, each of the $(n-2)^{th}$ fraction, the $(n-1)^{th}$ fraction, and the $n^{th}$ fraction may independently comprise dissolved hydrogen; the hydrocarbon feed may comprise a crude oil fraction; at least 50 wt. % of hydrocarbons in the hydrocarbon feed may boil at a temperature of between 180° C. and 370° C., based on the total weight of hydrocarbons in the hydrocarbon feed; n may equal 3; at least 50 wt. % of hydrocarbons in the $(n-2)^{th}$ fraction may boil at a temperature of between 180° C. and 260° C., based on the total weight of hydrocarbons in the $(n-2)^{th}$ fraction; at least 50 wt. % of hydrocarbons in the $(n-1)^{th}$ fraction may boil at a temperature of between 260° C. and 316° C., based on the total weight of hydrocarbons in the $(n-1)^{th}$ fraction; at least 50 wt. % of hydrocarbons in the $n^{th}$ fraction may boil at a temperature of between 316° C. and 370° C., based on the total weight of hydrocarbons in the $n^{th}$ fraction; the $n^{th}$ effluent may comprise less than 10 parts per million by weight (ppmw) of sulfur and less than 10 ppmw of nitrogen; the $(n-2)^{th}$ hydroprocessing reaction zone may be operated with a greater liquid hourly space velocity (LHSV) than the $(n-1)^{th}$ hydroprocessing reaction zone; and the $(n-1)^{th}$ hydroprocessing reaction zone may be operated with a greater LHSV than the $n^{th}$ hydroprocessing reaction zone.

EXAMPLES

The various aspects of the present disclosure will be further clarified by the following examples. The examples are illustrative in nature and should not be understood to limit the subject matter of the present disclosure.

Comparative Example 1 (CE-1)

In Comparative Example 1, a hydrocarbon feed was hydrodesulfurized in a single hydrotreating reactor over a Co—Ni—Mo/$Al_2O_3$ catalyst. The hydrocarbon feed was derived from an Arabian crude oil. The properties of the hydrocarbon feed, which boiled nominally in the range of from 180° C.-370° C., are given in Table 1. The single hydrotreating reactor was operated at the conditions shown in Table 2. The outlet of the hydrotreating reactor comprised 10 parts per million by weight (ppmw) sulfur.

It should be understood that temperature delta determinations were not made as CE-1 was conducted in a small pilot plant where excessive heat loss makes temperature delta determinations difficult.

TABLE 1

Properties of the Hydrocarbon Feed

| Property/Composition | Units | Whole Cut |
|---|---|---|
| Fractions | ° C. | 180-370 |
| density | g/cc | 0.8542 |
| Yield | wt. % | 100.0 |
| Sulfur | wt. % | 1.4 |
| Nitrogen | ppmw | 74 |
| 0 wt. % | ° C. | 185 |
| 5 wt. % | ° C. | 224 |
| 10 wt. % | ° C. | 229 |
| 30 wt. % | ° C. | 282 |
| 50 wt. % | ° C. | 306 |
| 70 wt. % | ° C. | 340 |
| 90 wt. % | ° C. | 375 |
| 95 wt. % | ° C. | 389 |
| 100 wt. % | ° C. | 401 |

TABLE 2

Hydrodesulphurization operating conditions

| Operating Variable | Units | Value |
|---|---|---|
| Hydrogen partial pressure | bar | 40 |
| Temperature (WABT) | ° C. | 370 |
| LHSV | $h^{-1}$ | 0.780 |
| Hydrodesulphurization | wt. % | 99.93 |
| Catalyst volume | $M^3$ | 129 |

Example 2 (EX-2)

The same hydrocarbon feed used in CE-1 was fractionated into a 180° C. to 260° C. fraction, a 260° C. to 316° C. fraction, and a 316° C. to 370° C. fraction. The hydrocarbon feed fractions were hydroprocessed according to embodiments of the present disclosure, using a multi-zone, fixed bed, single reactor as described in FIG. 1 with "n"=3. The properties and composition of each fraction are shown in Table 3. A Co—Ni—Mo/$Al_2O_3$ hydrodesulphurization catalyst was used in each reaction zone. A co-current, 3-phase (hydrogen, hydrocarbons, and catalyst) hydrogen feed was used in EX-2. Details of the operating parameters for each hydroprocessing reaction zone are provided in Table 4.

The first fraction, boiling in the range 316° C. to 370° C., was fed to the first reaction zone. 55.1 wt. % of the sulfur in the first fraction (based on the total weight of sulfur and hydrocarbons in the first fraction) was removed to obtain 1.0 wt. % sulfur in the first bed reaction effluent (based on the total weight of hydrocarbons and sulfur in the first bed reaction effluent). The hydroprocessing reaction in the first bed produced 15.9 kcal/mol of heat, resulting in a 24° C. temperature delta between the top and bottom of the first catalyst bed.

The second fraction, boiling in the range 260° C. to 316° C., was fed to the reactor at the bottom of the first catalyst bed (and the top of a second catalyst bed) to cool the first catalyst bed reaction effluent. The first catalyst bed effluent and the fraction boiling in the range 260° C. to 316° C. were hydrodesulfurized in the second catalyst bed. 85.4 wt. % of the sulfur in the combined feed to the combined first and second catalyst beds (based on total weight of sulfur and hydrocarbons fed to the combined first and second catalyst beds) was removed from the combined feed to obtain 1200 ppmw sulfur in the second catalyst bed effluent. The hydroprocessing reaction in the second catalyst bed produced 6.7 kcal/mol of heat, resulting in an 11° C. temperature delta across the second bed.

The third fraction, boiling in the range 180° C. to 260° C., was fed to the reactor at the bottom of the second catalyst bed (and the top of the third catalyst bed) to cool the second catalyst bed reaction effluents. The second catalyst bed effluents and the third fraction were hydroprocessed in the third bed. Over 99.9 wt. % of the sulfur fed to the hydroprocessing unit (based on the total weight of hydrocarbons and sulfur fed to the hydroprocessing unit) was removed from the combined feed to obtain 10 ppmw sulfur product (based on the total weight of hydrocarbons and sulfur in the third catalyst bed effluent). The hydroprocessing reaction in the third catalyst bed produced 10.7 kcal/mol of heat, resulting in a 35° C. temperature delta across the third catalyst bed.

TABLE 3

Properties of Each Fraction

| Property/Composition | Units | 1st fraction | 2nd fraction | 3rd fraction |
|---|---|---|---|---|
| Fractions | ° C. | 316-370 | 260-370 | 180-260 |
| density | g/cc | 0.8869 | 0.8514 | 0.8172 |
| Yield | W % | 37.4 | 31.8 | 30.8 |
| Sulfur | wt. % | 2.3 | 1.4 | 0.5 |
| Nitrogen | ppmw | 100 | 67 | 50 |
| 0 wt. % | ° C. | 310 | 248 | 185 |
| 5 wt. % | ° C. | 331 | 271 | 203 |
| 10 wt. % | ° C. | 338 | 278 | 211 |
| 30 wt. % | ° C. | 351 | 292 | 227 |
| 50 wt. % | ° C. | 362 | 304 | 239 |
| 70 wt. % | ° C. | 373 | 317 | 255 |
| 90 wt. % | ° C. | 387 | 329 | 272 |
| 95 wt. % | ° C. | 392 | 333 | 276 |
| 100 wt. % | ° C. | 401 | 343 | 286 |

TABLE 4

| Variable | Units | 1st reaction zone | 2nd reaction zone | 3rd reaction zone |
|---|---|---|---|---|
| Feed rate | Kg/h | 374 | 692 | 1002 |
| Hydrogen partial pressure | kpa | 4000 | 4000 | 4000 |
| LHSV | $h^{-1}$ | 7.255 | 2.617 | 0.900 |
| HDS | wt. % | 55.06 | 87.61 | 99.00 |
| Catalyst Volume | $M^3$ | 4.2 | 16.5 | 61.1 |
| WABT | ° C. | 330 | 330 | 335 |
| $Temperature_{inlet}$ | ° C. | 318 | 318 | 330 |
| $Temperature_{delta}$ | ° C. | 24.2 | 24.6 | 10.7 |

The total catalyst volume used in EX-2 was 81.8 $M^3$. In contrast, 129 $M^3$ of catalyst was required in CE-1, to achieve the same level of desulfurization. This shows a 36.5% reduction in catalyst volume, and therefore an even greater reduction (as no quench space was required either) in total reactor volume.

As no quench gas was used in the present example, no quench space was required in the hydroprocessing reactor. In contrast, if a comparable system used quench gas, at least two meters of quench space would have been required in the hydroprocessing reactor.

It is noted that any two quantitative values assigned to a property may constitute a range of that property, and all combinations of ranges formed from all stated quantitative values of a given property are contemplated in this disclosure.

It is noted that one or more of the following claims utilize the term "where" as a transitional phrase. For the purposes of defining the present technology, it is noted that this term is introduced in the claims as an open-ended transitional phrase that is used to introduce a recitation of a series of characteristics of the structure and should be interpreted in like manner as the more commonly used open-ended preamble term "comprising."

Having described the subject matter of the present disclosure in detail and by reference to specific aspects, it is noted that the various details of such aspects should not be taken to imply that these details are essential components of the aspects. Rather, the claims appended hereto should be taken as the sole representation of the breadth of the present disclosure and the corresponding scope of the various aspects described in this disclosure. Further, it will be apparent that modifications and variations are possible without departing from the scope of the appended claims.

What is claimed is:

1. A method of hydroprocessing a hydrocarbon feed, the method comprising:

fractionating the hydrocarbon feed into "n" fractions, wherein "n" is at least 2;

hydroprocessing an $(n-1)^{th}$ fraction of the hydrocarbon feed in an $(n-1)^{th}$ hydroprocessing reaction zone of a hydroprocessing unit, thereby producing an $(n-1)^{th}$ effluent; and hydroprocessing the $n^{th}$ fraction and the $(n-1)^{th}$ effluent in an $n^{th}$ hydroprocessing reaction zone, thereby producing an $n^{th}$ effluent; wherein the $(n-1)^{th}$ hydroprocessing reaction zone is upstream of the $n^{th}$ hydroprocessing reaction zone;

the $(n-1)^{th}$ fraction has a greater boiling point range than the $n^{th}$ fraction; and hydrogen and the hydrocarbon feed are in co-current flow in the hydroprocessing unit.

2. The method of claim 1, wherein "n" is at least 3; the method further comprising hydroprocessing an $(n-2)^{th}$ fraction of the hydrocarbon feed in an $(n-2)^{th}$ hydroprocessing reaction zone of a hydroprocessing unit, thereby producing an $(n-2)^{th}$ effluent; wherein:

hydroprocessing the $(n-1)^{th}$ fraction of the hydrocarbon feed occurs in conjunction with the $(n-2)^{th}$ effluent, thereby producing the $(n-1)^{th}$ effluent;

the $(n-2)^{th}$ hydroprocessing reaction zone is upstream of the $(n-1)^{th}$ hydroprocessing reaction zone; and the $(n-2)^{th}$ fraction has a greater boiling point range than the $(n-1)^{th}$ fraction.

3. The method of claim 1, wherein each of the $(n-1)^{th}$ fraction and the $n^{th}$ fraction independently comprise dissolved hydrogen before being introduced to their respective hydroprocessing reaction zones.

4. The method of claim 1, wherein no gaseous hydrogen is provided to the hydroprocessing reaction zones.

5. The method of claim 1, wherein no quench gas or liquid, other than the hydrocarbon feed fractions, is introduced into the hydroprocessing unit.

6. The method of claim 1, wherein the hydrocarbon feed comprises a crude oil fraction.

7. The method of claim 1, wherein:

the hydrocarbon feed comprises a crude oil fraction; and at least 50 wt. % of hydrocarbons in the hydrocarbon feed boil at a temperature of between 180° C. and 370° C., based on the total weight of hydrocarbons in the hydrocarbon feed.

8. The method of claim 2, wherein:

the hydrocarbon feed comprises a crude oil fraction;

at least 50 wt. % of hydrocarbons in the hydrocarbon feed boil at a temperature of between 180° C. and 370° C., based on the total weight of hydrocarbons in the hydrocarbon feed;

n is equal to 3;

at least 50 wt. % of hydrocarbons in the $(n-2)^{th}$ fraction boil at a temperature of between 180° C. and 260° C., based on the total weight of hydrocarbons in the $(n-2)^{th}$ fraction;

at least 50 wt. % of hydrocarbons in the $(n-1)^{th}$ fraction boil at a temperature of between 260° C. and 316° C., based on the total weight of hydrocarbons in the $(n-1)^{th}$ fraction;

at least 50 wt. % of hydrocarbons in the $n^{th}$ fraction boil at a temperature of between 316° C. and 370° C., based on the total weight of hydrocarbons in the $n^{th}$ fraction.

9. The method of claim 1, wherein the method of hydroprocessing the hydrocarbon feed reduces a heteroatom content of the hydrocarbon feed, reduces an aromatic content of the hydrocarbon feed, reduces a molecular weight of the hydrocarbons in the hydrocarbon feed, or a combination of these.

10. The method of claim 1, wherein the $(n-1)^{th}$ hydroprocessing reaction zone is operated with a greater LHSV than the $n^{th}$ hydroprocessing reaction zone.

11. The method of claim 1, wherein an inlet temperature of the $(n-1)^{th}$ hydroprocessing reaction zone is different from an inlet temperature of the $n^{th}$ hydroprocessing reaction zone.

12. The method of claim 2, wherein temperature profiles of each of the $(n-2)^{th}$ hydroprocessing reaction zone, the $(n-1)^{th}$ hydroprocessing reaction zone, and the $n^{th}$ hydroprocessing reaction zone are independently not isothermal.

13. The method of claim 2, wherein a hydrogen partial pressure in the in each of the $(n-2)^{th}$ hydroprocessing reaction zones, the $(n-1)^{th}$ hydroprocessing reaction zones, and the $n^{th}$ hydroprocessing reaction zone is independently from 10 bar to 200 bar.

14. The method of claim 1, wherein a hydrogen partial pressure of the $n^{th}$ hydroprocessing reaction zone is less than the hydrogen partial pressure in the $(n-1)^{th}$ hydroprocessing reaction zone.

15. The method of claim 1, wherein a weighted average bed temperature (WABT) temperature of each hydroprocessing reaction zone of the hydroprocessing unit is from 200° C. to 450° C.

16. The method of claim 2, wherein an LHSV of each of the $(n-2)^{th}$ hydroprocessing reaction zones, the $(n-1)^{th}$ hydroprocessing reaction zones, and the $n^{th}$ hydroprocessing reaction zone is independently from 0.1 $h^{-1}$ to 10 $h^{-1}$.

17. The method of claim 2, wherein a temperature differential across each of the $(n-2)^{th}$ hydroprocessing reaction zone, the $(n-1)^{th}$ hydroprocessing reaction zone, and the $n^{th}$ hydroprocessing reaction zone is independently less than 40° C.

18. The method of claim 1, wherein the hydroprocessing unit comprises mixing zones.

19. The method of claim 2, wherein:

each of the $(n-2)^{th}$ fraction, the $(n-1)^{th}$ fraction, and the $n^{th}$ fraction independently comprise dissolved hydrogen;

the hydrocarbon feed comprises a crude oil fraction;

at least 50 wt. % of hydrocarbons in the hydrocarbon feed boil at a temperature of between 180° C. and 370° C., based on the total weight of hydrocarbons in the hydrocarbon feed;

n is equal to 3;

at least 50 wt. % of hydrocarbons in the $(n-2)^{th}$ fraction boil at a temperature of between 180° C. and 260° C., based on the total weight of hydrocarbons in the $(n-2)^{th}$ fraction;

at least 50 wt. % of hydrocarbons in the $(n-1)^{th}$ fraction boil at a temperature of between 260° C. and 316° C., based on the total weight of hydrocarbons in the $(n-1)^{th}$ fraction;

at least 50 wt. % of hydrocarbons in the $n^{th}$ fraction boil at a temperature of between 316° C. and 370° C., based on the total weight of hydrocarbons in the $n^{th}$ fraction;

the $n^{th}$ effluent comprises less than 10 parts per million by weight (ppmw) of sulfur and less than 10 ppmw of nitrogen;

the $(n-2)^{th}$ hydroprocessing reaction zone is operated with a greater liquid hourly space velocity (LHSV) than the $(n-1)^{th}$ hydroprocessing reaction zone; and the $(n-1)^{th}$ hydroprocessing reaction zone is operated with a greater LHSV than the $n^{th}$ hydroprocessing reaction zone.

* * * * *